US011187480B1

(12) United States Patent
Anderson

(10) Patent No.: US 11,187,480 B1
(45) Date of Patent: Nov. 30, 2021

(54) MAGAZINE LOADER

(71) Applicant: Russell Anderson, Frisco, TX (US)

(72) Inventor: Russell Anderson, Frisco, TX (US)

( * ) Notice: Subject to any disclaimer, the term of this patent is extended or adjusted under 35 U.S.C. 154(b) by 0 days.

(21) Appl. No.: 17/143,971

(22) Filed: Jan. 7, 2021

(51) Int. Cl.
*F41A 9/83* (2006.01)

(52) U.S. Cl.
CPC ..... *F41A 9/83* (2013.01)

(58) Field of Classification Search
CPC ..... F41A 9/82; F41A 9/83
See application file for complete search history.

(56) References Cited

U.S. PATENT DOCUMENTS

| | | | | |
|---|---|---|---|---|
| 4,304,062 | A * | 12/1981 | Pepe | F41A 9/83 42/87 |
| 4,939,862 | A * | 7/1990 | Brandenburg | F41A 9/83 42/87 |
| 10,254,061 | B1 * | 4/2019 | Loveday, IV | F41A 9/64 |
| 10,845,144 | B1 * | 11/2020 | Witecha | F41A 9/84 |
| 2003/0093936 | A1 * | 5/2003 | Pikula | F41A 9/83 42/87 |

OTHER PUBLICATIONS

Screen capture from YouTube video clip entitled "Glock Magazine SPEEDLOADER Perfection", Aug. 18, 2016, Retrieved from: https://youtu.be/BQBpRmAFCul.
Screen capture from YouTube video clip entitled "Fastest Mag Loader in the World", Apr. 11, 2018, Retrieved from: https://www.youtube.com/watch?v=idP73lulrVI.

* cited by examiner

*Primary Examiner* — J. Woodrow Eldred
(74) *Attorney, Agent, or Firm* — Vierra Magen Marcus LLP

(57) ABSTRACT

A weapon magazine loading apparatus includes a magazine guide channel, a magazine loading region at the base of the magazine guide channel and an ammunition holding ramp. The loading region has an ammunition round holding depression in a base surface of the loading region, and a spring-loaded retaining wall positioned adjacent to the round holding depression. The retaining wall is movable between a first position extending into the loading channel and a second position below the base surface under pressure exerted on a magazine in the channel. The holding ramp positioned adjacent to the magazine loading region and holds a plurality of rounds of ammunition at an angle such that a round of ammunition in the ramp will roll toward the magazine loading region. The depth and width of the magazine holding region is adjustable to accommodate different types of magazines and calibers of ammunition.

19 Claims, 19 Drawing Sheets

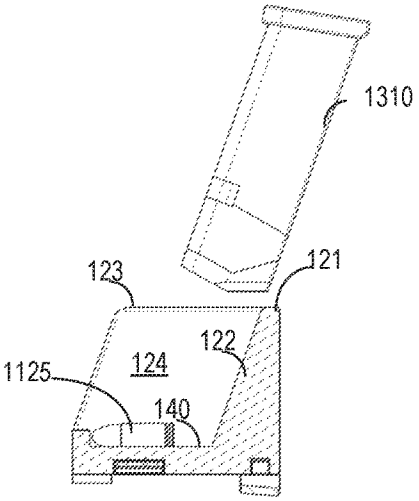
FIG 15A
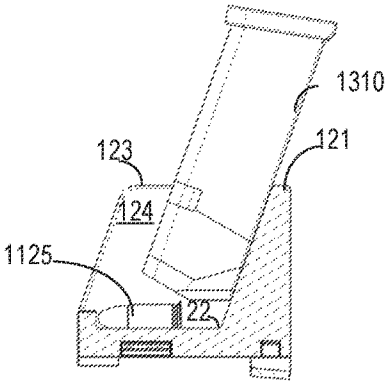
FIG 15B
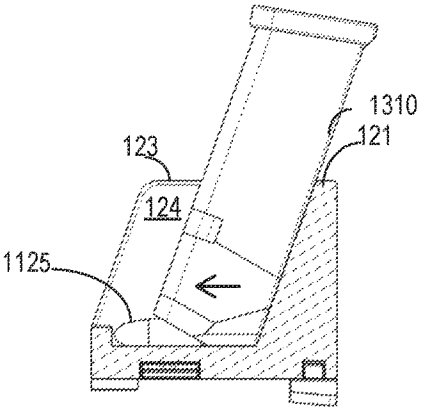
FIG 15C
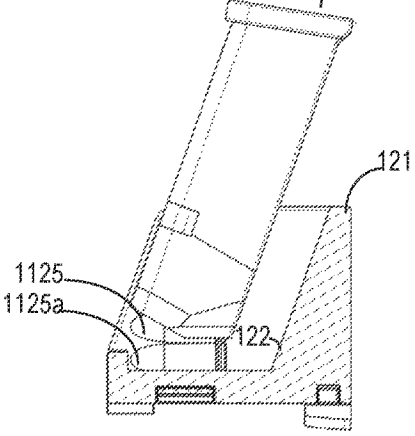
FIG 15D
FIG 15E
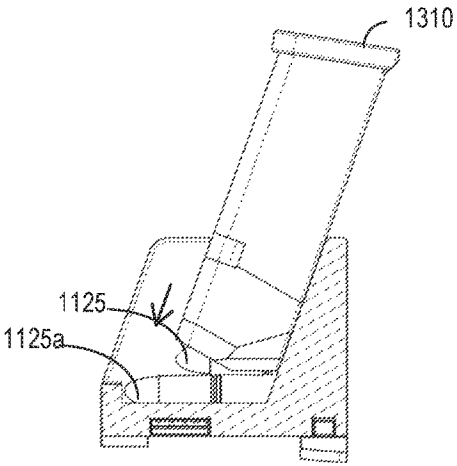
FIG 15F

DETAIL D

MAGAZINE LOADER

TECHNICAL FIELD

The present technology relates to a system for loading ammunition into a weapon magazine.

BACKGROUND

Semi-automatic weapons generally include an ammunition magazine disposed in the handle or another portion of the weapon's frame wherein rounds of ammunition stored in the magazine are individually fed from the magazine into a firing chamber of the weapon. The advantages of the magazine are the large capacity of ammunition storage and the quick loading operation of the magazine into the weapon.

In order to load the magazine, the ammunition generally must be individually fed in the magazine one by one. Different magazines have different capacities and as each round is loaded, a spring positioned in the magazine which urges rounds into the firing chamber also provides a resistive force to loading the magazine. This resistance to adding additional ammunition increases as the magazine becomes fuller. In addition, while mechanisms have been developed which aid in loading magazines, they generally require good hand and thumb strength, as well as dexterity. Therefore, the process of loading the ammunition in the magazine can be a time-consuming and somewhat difficult operation.

SUMMARY

One general aspect includes a weapon magazine loading apparatus. The weapon magazine loading apparatus includes a magazine guide channel having a back surface, a first side surface and a second side surface; a magazine loading region at a base of the magazine guide channel, the magazine loading region including a base surface, an ammunition round holding depression formed in the base surface, and a spring-loaded retaining wall positioned adjacent to the round holding depression, the retaining wall movable between a first position extending into the loading region above the base surface and a second position even with the base surface; and an ammunition holding ramp positioned adjacent to the magazine loading region, the ramp adapted to hold a plurality of rounds of ammunition, the ramp being positioned at an angle such that a round of ammunition in the ammunition holding ramp will move toward the magazine loading region.

Implementations may include one or more of the above features where the retaining wall is attached to a leaf spring positioned below the loading region. Implementations may include any one or more of the above features magazine guide channel has a width between the first side surface and the second side surface which allows a weapon magazine to pass therethrough will minimal resistance. Implementations may include any one or more of the above features wherein guide channel has a width between the first side surface and the second side surface, and where the magazine guide channel is adapted to include a width adjustment structure. Implementations may include any one or more of the above features wherein the width adjustment structure includes at least one spacer mounting structure and at least one spacer. Implementations may include any one or more of the above features wherein the width adjustment structure includes at least one spacer mounting structure on each of the first side surface and the second side surface, and at least one spacer for each mounting structure. Implementations may include any one or more of the above features wherein the width of the guide channel is sufficient to allow a double-stack magazine therein, and where a first adjustment structure reduces the width such that the guide channel is adapted to receive a stack-and-a-half magazine. Implementations may include any one or more of the above features wherein the width of the guide channel is sufficient to allow a double-stack magazine therein, and where a first adjustment structure reduces the width such that the guide channel is adapted to receive a single stack magazine. Implementations may include any one or more of the above features wherein the width of the guide channel is sufficient to allow a double-stack magazine therein, and where a first adjustment structure reduces the width such that the guide channel is adapted to receive a stack-and-a-half magazine; and a second adjustment structure reduces the width such that the guide channel is adapted to receive a single stack magazine. Implementations may include any one or more of the above features wherein the apparatus further includes a loading clip adapted to secure a plurality of ammunition rounds in a row, the loading clip removably secured to a wall adjacent to the holding ramp.

Another general aspect includes an apparatus having an adjustable guide channel having a base surface, a back surface, a first side surface and a second side surface; a loading region adjacent to the base surface of the guide channel, the loading region including an ammunition round holding depression formed in the base surface, and a movable retaining element positioned adjacent to the holding depression, the retaining element movable between a first position extending into the loading region above the base surface and a second position even with the base surface; and an ammunition holding ramp positioned adjacent to the loading region, the ramp being positioned at an angle such that a round of ammunition in the ammunition holding ramp will move toward the magazine loading region.

Implementations may include any one or more of the above features wherein the retaining element is attached to a leaf spring positioned below the loading region. Implementations may include any one or more of the above features wherein the guide channel has a width between the first side surface and the second side surface, and where the magazine guide channel is adapted to include a width adjustment structure. Implementations may include any one or more of the above features wherein the width adjustment structure includes at least one spacer mounting structure and at least one spacer. Implementations may include any one or more of the above features wherein the width adjustment structure includes at least one spacer mounting structure on each of the first side surface and the second side surface, and at least one spacer for each mounting structure. Implementations may include any one or more of the above features wherein the apparatus further includes a back spacer mounting structure positioned on the back surface. Implementations may include any one or more of the above features wherein the ramp includes a top surface adapted to hold ammunition and a bottom surface, and the bottom surface includes at least one spacer mounting structure adapted to secure each said spacer to the bottom surface. Implementations may include any one or more of the above features wherein the apparatus further including a loading clip adapted to secure a plurality of ammunition rounds in a row, the loading clip removably secured to a wall adjacent to the holding ramp.

One general aspect includes a method of loading an ammunition magazine including loading a plurality of rounds of ammunition into an ammunition holding ramp which feeds a magazine loading region, the ramp being positioned at an angle such that a round of ammunition in the ammunition holding ramp will move toward the magazine loading region. The method of loading includes adjusting a size of a magazine guide channel positioned above the magazine loading region, the magazine guide channel having a back surface, a first side surface and a second side surface, by securing one or more spacers to at least one of the surfaces; inserting a magazine into the magazine loading channel and engaging an ammunition round secured in a holding depression formed in the base surface. The method of loading further includes depressing the magazine against a spring-loaded retaining element positioned adjacent to the round holding depression to insert the round into the magazine. The method of loading includes lifting the magazine in the channel to allow another of the plurality of rounds to roll on the ramp into the holding depression. The method of loading includes repeating the depressing and lifting so that all of the plurality of rounds are inserted into the magazine.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Embodiments of the present technology relating to both structure and method of operation may best be understood by referring to the following description and accompanying drawings, in which similar reference characters denote similar elements throughout the several views:

FIGS. 15A-15F are views along line B-B in FIG. 13 and illustrate loading of rounds into a magazine clip using any of the magazine loading devices disclosed herein.

DETAILED DESCRIPTION

Described herein is a weapon magazine loading apparatus. The apparatus includes a magazine guide channel, a magazine loading region at the base of the magazine guide channel and an ammunition holding ramp. The loading region has an ammunition round holding depression in a base surface of the loading region, and a spring-loaded retaining wall positioned adjacent to the round holding depression. The retaining wall is movable between a first position extending into the loading channel and a second position below the base surface under pressure exerted on a magazine in the channel. The holding ramp positioned adjacent to the magazine loading region and holds a plurality of rounds of ammunition at an angle such that a round of ammunition in the ramp will roll toward the magazine loading region. In some embodiments, the depth and width of the magazine holding region is adjustable to accommodate different types of magazine and calibers of ammunition.

FIGS. 1-7 illustrate a first embodiment of a magazine loading apparatus 100 in accordance with the present technology. (It should be understood that all reference numbers discussed below may not be shown in all figures given the nature of the item referenced and the perspective of the figure.) Magazine loading apparatus includes a magazine holding channel 120, a magazine loading region 145, and an ammunition holding ramp 110.

Figure 1:
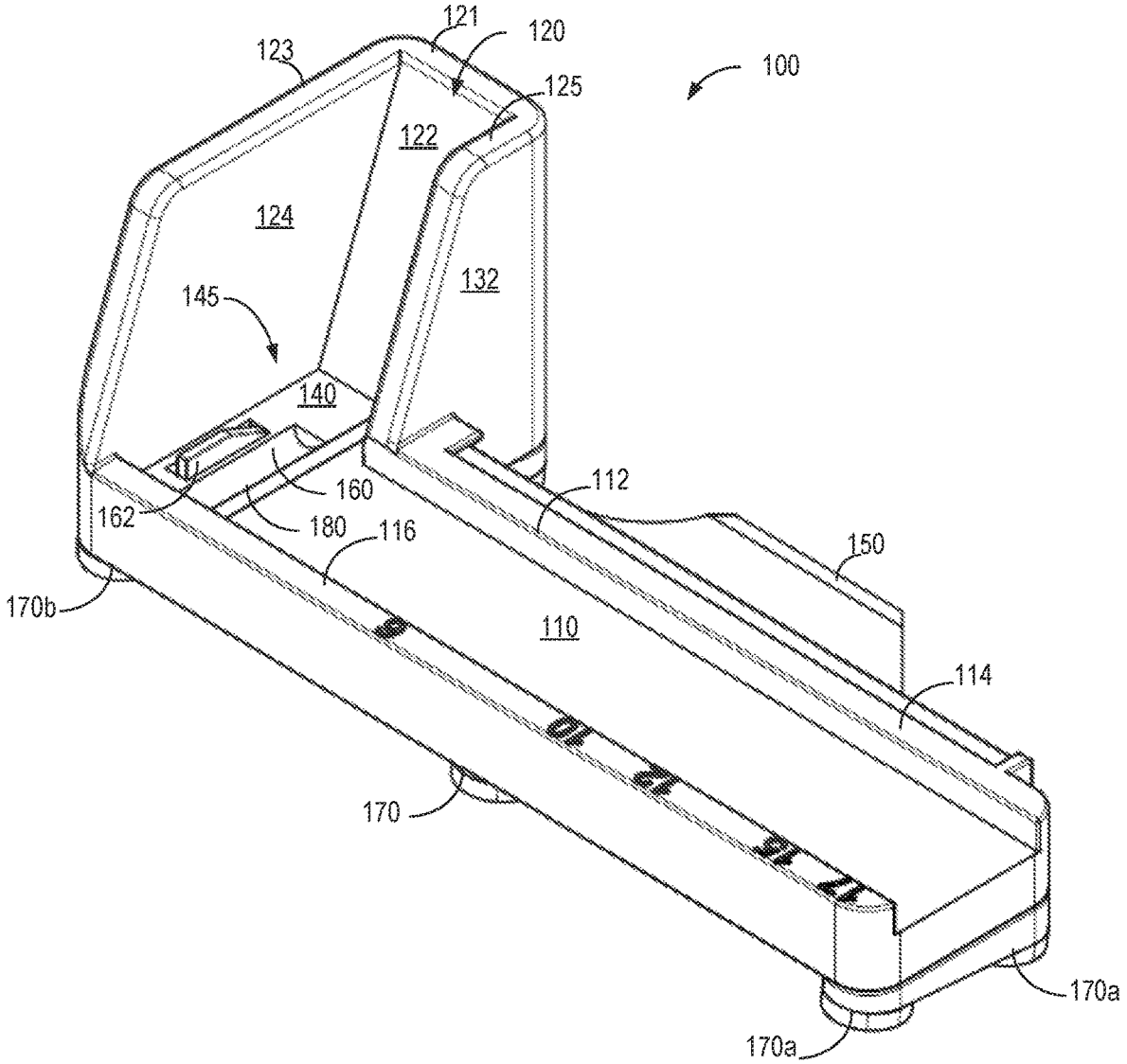
FIG. 1 depicts a perspective view of a magazine loading device.
Figure 2:
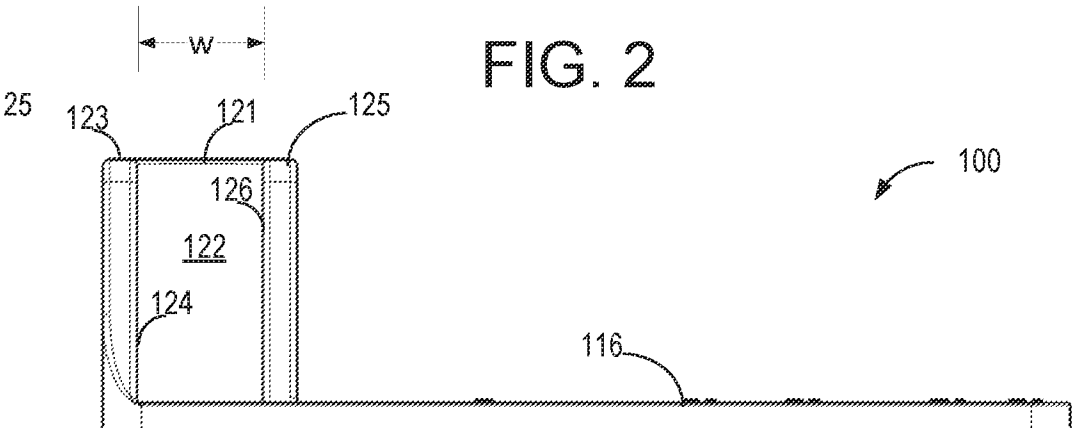
FIG. 2 is a front view of the magazine loading device depicted in FIG. 1.
Figure 3:
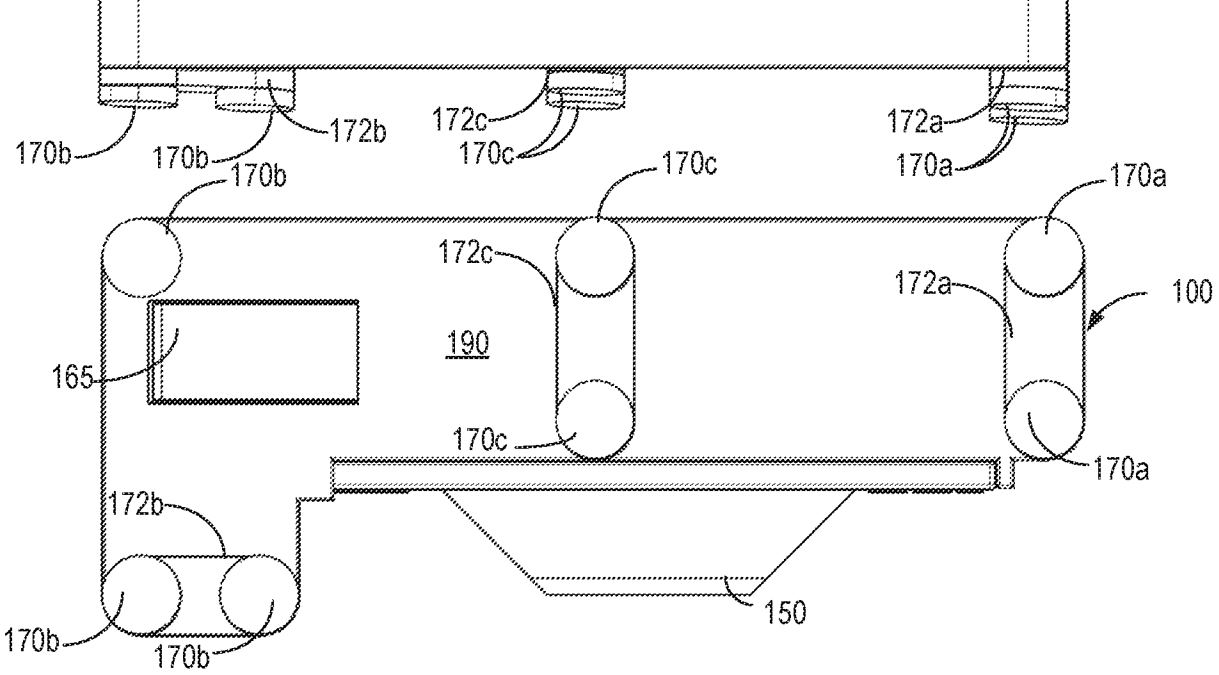
FIG. 3 is a bottom view of the magazine loading device depicted in FIG. 1.
Figure 4:
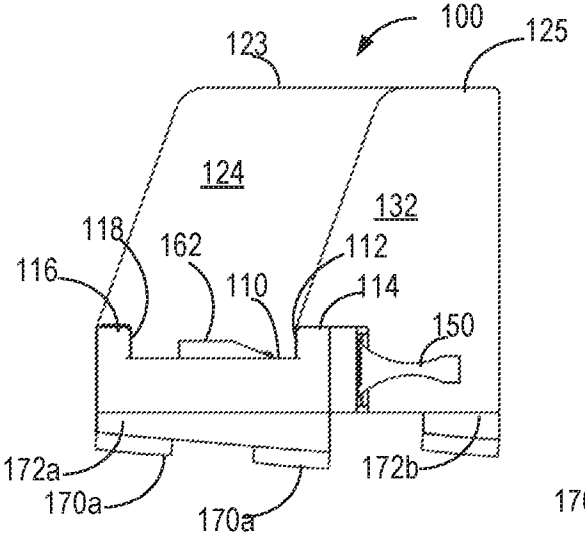
FIG. 4 is a first end view of the magazine loading device depicted in claim 1.

The magazine loading region 145 includes a base surface 140, an ammunition round holding depression 160, and a spring wall 162. The ammunition holding ramp 110 is defined by a rear wall 114 and a forward wall 116 each having an interior surface 112, 118, respectively, which maintains the ammunition in the ammunition holding ramp 110. The plurality of feet 170 allow the magazine loading apparatus 100 to rest on the surface of a table or other planar element. As illustrated in FIG. 2, the height of the feet 170*a* are greater than feet 170*b* (and middle feet 170*c*) so that the ammunition holding ramp 110 is angled to cause ammunition to roll toward the magazine loading region 145. In one embodiment, the height of the feet 170 are controlled by feet mounts 172*a*, 172*b*, 172*c* which may be integral to the apparatus 100 or formed separately and attached to the apparatus. As also illustrated in FIGS. 1-7, (in FIGS. 14A and 14B), and, with respect to a forward angle, in FIG. 4, the feet mounts are angled so that the back wall 114 of the ammunition holding ramp is higher than the front wall 114 when the apparatus is resting on the surface of a table or other planar element. The ammunition holding ramp 110 allows a plurality of ammunition rounds to be fed into the magazine loading region 145 as a magazine in the magazine holding channel 120 is repeatedly slid up and down therein to add additional rounds into a magazine as described below.

The magazine holding channel 120 is formed by walls 121, 123, and 125. Back wall 121 has a back surface 122 which provides the reference angle for the magazine as it is slid into the channel. Sidewall 123 has in inner surface 124 and sidewall 125 an inner surface 126. Magazine holding channel 120 has a depth "d" (FIG. 5) in relation to sidewall 125, and a width "w" (FIG. 2 defined by inner surfaces 124 and 126 Inner surfaces 124 and 126 are generally parallel and each formed normal to back surface 122. Back surface 122 is at an angle greater than 90 degrees relative to bottom surface 140 (illustrated in FIGS. 15G and 15H). The interior surfaces guide a magazine which may be slid into the magazine holding channel 120 as illustrated herein, and in one embodiment, the width "w" is sized such that a magazine slides into the magazine holding channel with little or no resistance when a surface of the magazine touches the back surface 122.

Also shown is a loading clip 150 which may be used to gather a plurality of ammunition rounds from a container and used to load the plurality of rounds into the ammunition holding ramp 110.

Base surface 140 of the loading region stops the progress of a magazine which is slid into the magazine holding channel 120. In operation, ammunition rounds roll down the ammunition holding ramp 110 into the loading region 145, and holding depression 160, being restricted from moving beyond holding depression 160 by spring wall 162, and held in depression 160 while a magazine is slid into the magazine holding channel 120 until an end of the magazine reaches base surface 140. Optionally, the depression is formed as a rectangular depression (when viewed from the top of magazine loading apparatus 100) and has a semi-circular cross-section which generally matches the cross-section of an ammunition round positioned therein. It will be understood that an exact match of the cross-section of the depression and the ammunition round is not required. At this point, the spring wall recedes into the opening 164 (illustrated in FIGS. 14A, 14B) in base surface 140 to allow the round positioned in depression 160 to enter the magazine. Note that the top surface portion of the spring wall 162 closest to back surface 122 is angled so that when fully extended in the magazine loading region 145, the end of the top surface portion of spring wall 162 closest to back surface 122 is level with base surface 140, and is angled to extend above surface 140 as the surface approaches wall 116. This allows the magazine to force the spring wall 162 downward as it is slid forward.

In one alternative, each embodiment of the apparatus 100 (and apparatus 1600, and 1700 described below) is manufactured of hardened plastic. In such embodiments, it may be advantageous to provide a durability strip 180 made of metal and embedded into the ramp 110 adjacent to depression 162. This reduces wear and tear on the loading region 145 due to repeated uses and allows at least part of the magazine to engage this strip rather than bottom surface 140.

Figure 6:
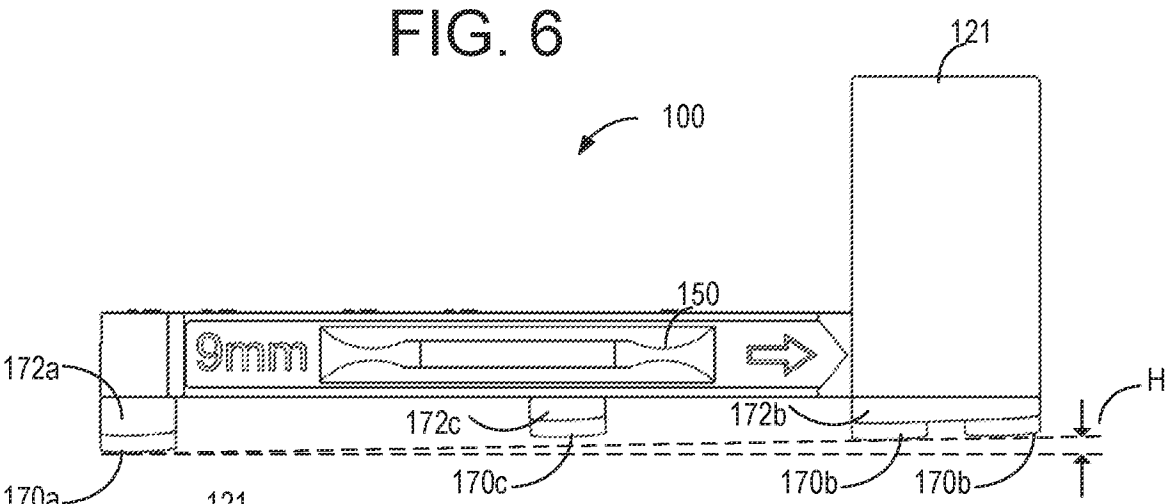
FIG. 6 is a rear view of the magazine loading device depicted in FIG. 1.
Figure 5:
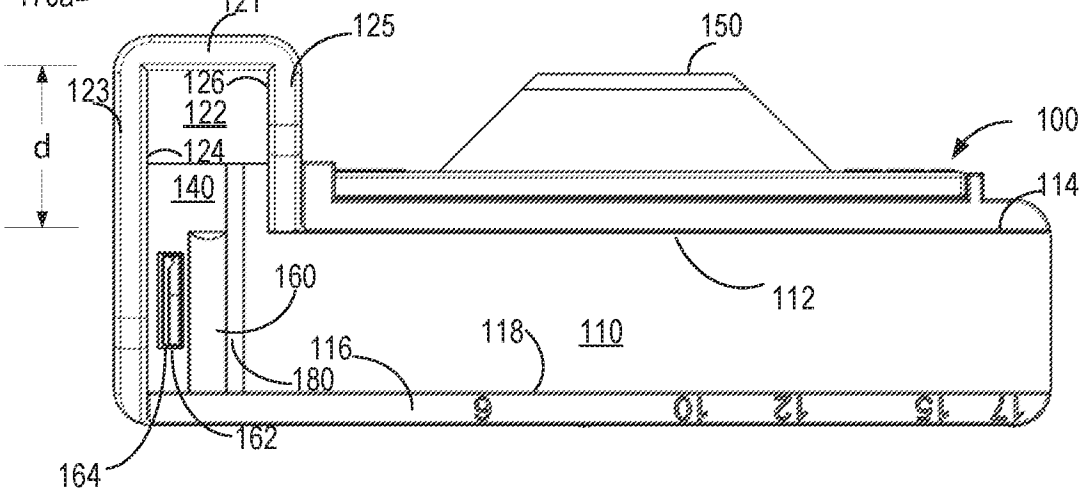
FIG. 5 is a top view of the magazine loading device depicted in FIG. 1.
Figure 7:
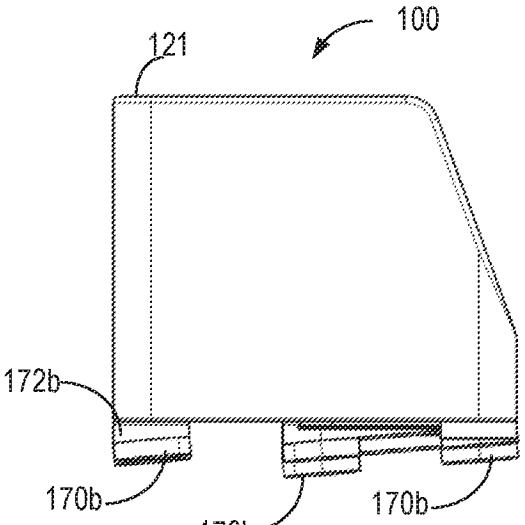
FIG. 7 is a second end view of the magazine to loading device depicted in FIG. 1.

Optionally, quantity markings (6, 10, 12, 15, 17, etc.) may be provided on the surface of wall 116 to indicate the number of rounds loaded in ammunition holding ramp 110. As illustrated in FIG. 6, the loading clip 150 may also have indicators or the size of ammunition for which the clip may be used.

In one embodiment, the magazine loading apparatus is sized to fit one caliber of ammunition. In one embodiment, the magazine loading apparatus 100 is constructed to fit one size of clip. It is well known that weapon magazines may have varying capacity.

This process is detailed further below with respect to FIGS. 13-15.

Figure 8A:
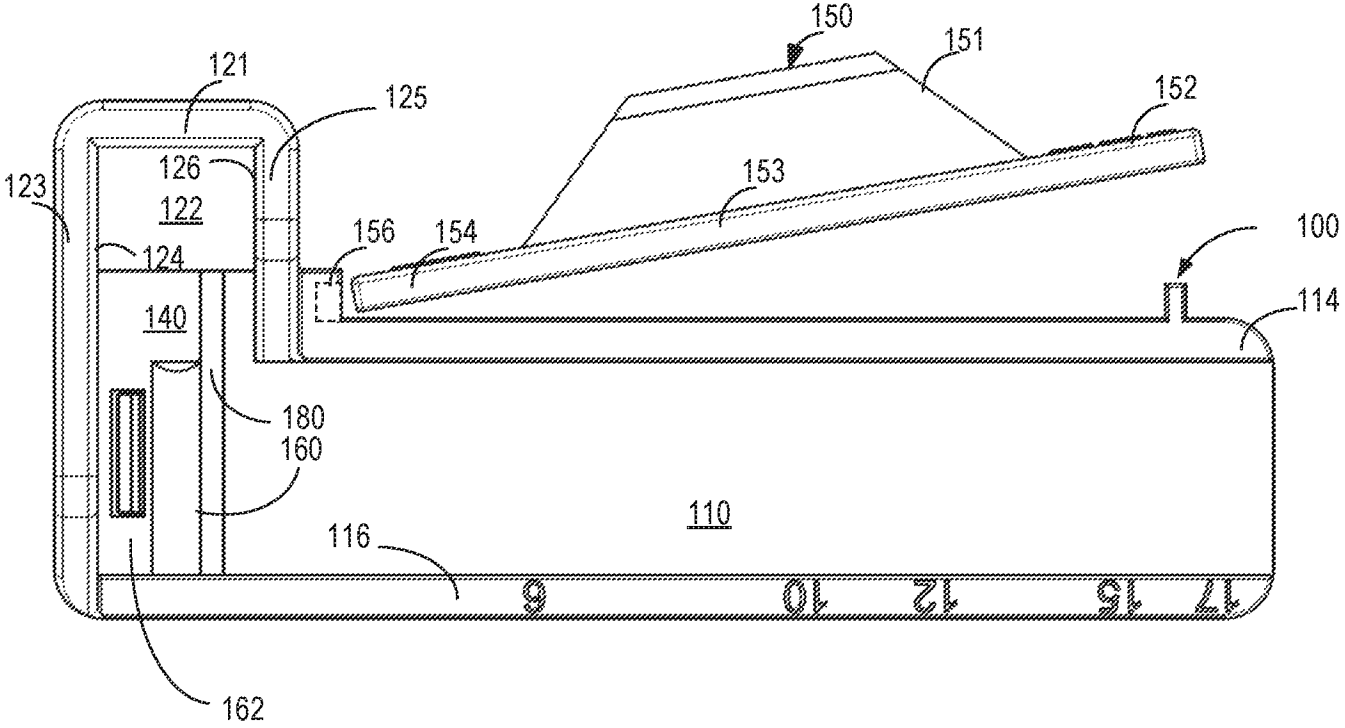
FIGS. 8A and 8B are top views of the magazine loading device depicted in FIG. 1 illustrating the loading clip being removed from the magazine loading device and being attached to the magazine loading device, respectively.
Figure 8B:
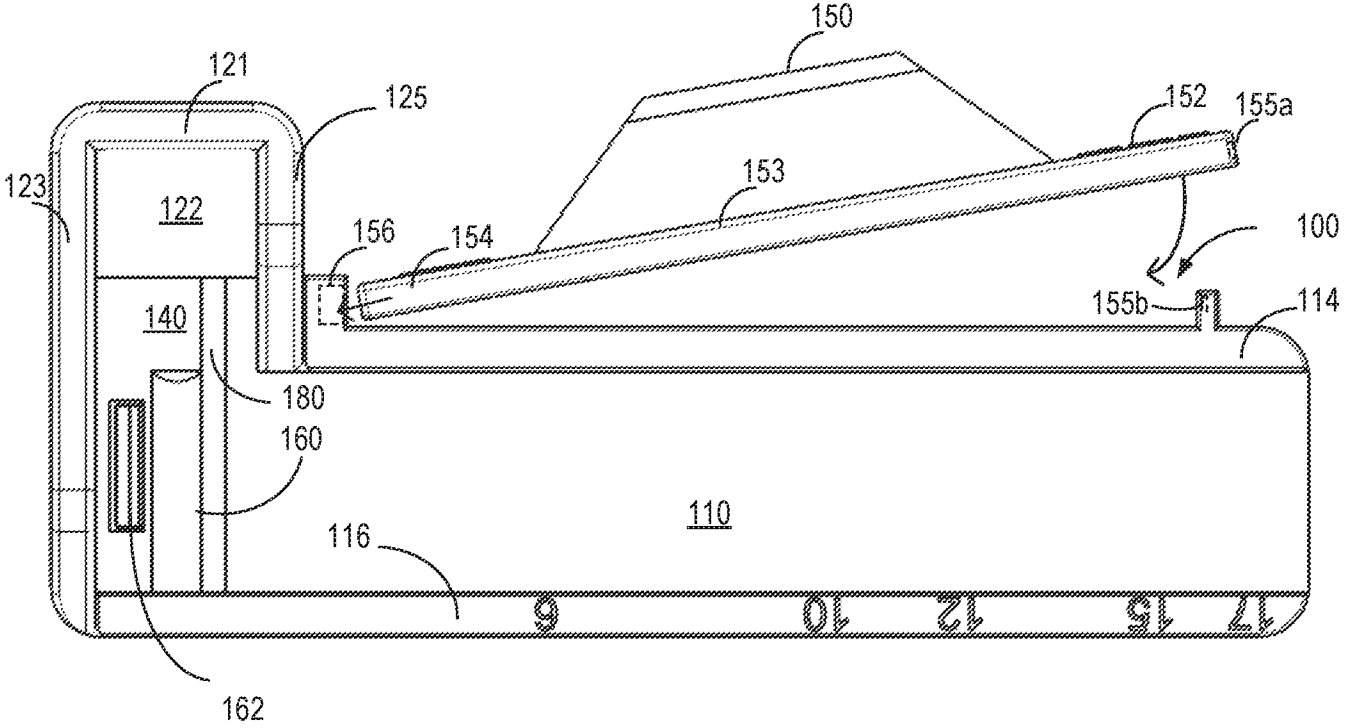
Figure 9:
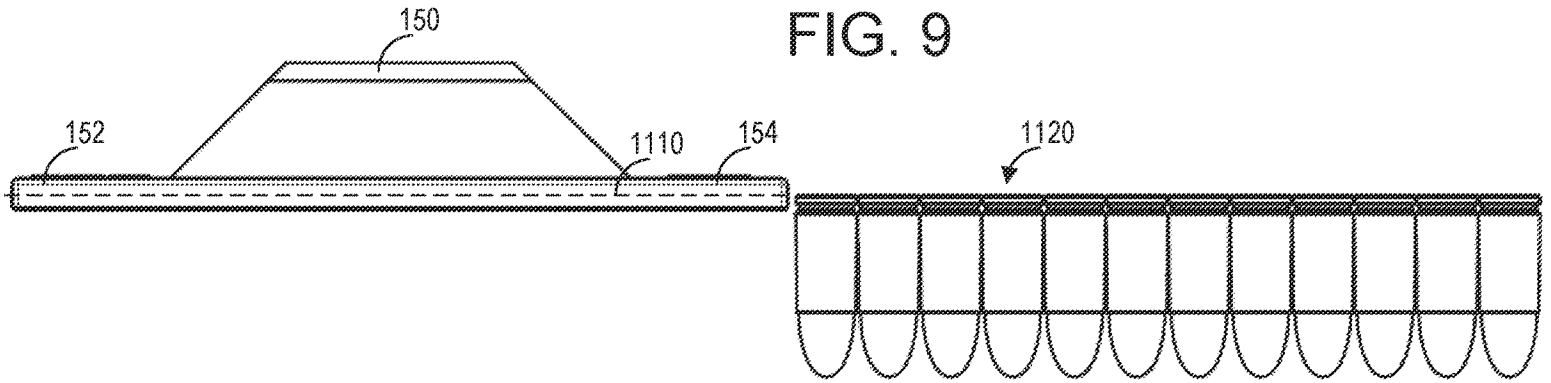
FIG. 9 is a front view of the loading clip receiving a plurality of rounds of ammunition.
Figure 10:
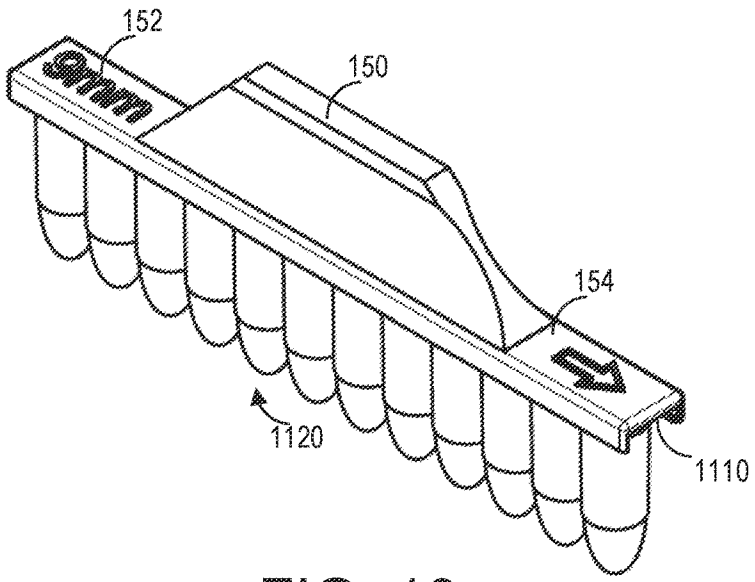
FIG. 10 is a perspective view of a loaded loading clip including a plurality of rounds of ammunition.
Figure 11:
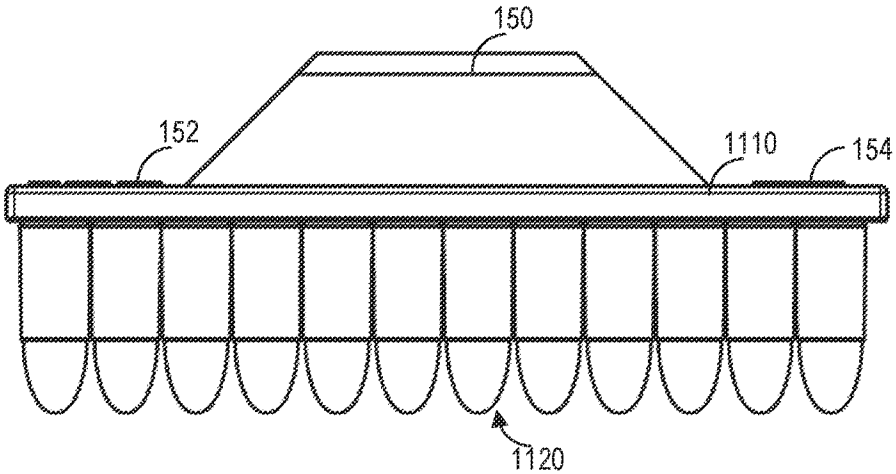
FIG. 11 is a front view of the fully loaded loading clip of FIG. 10.

FIGS. 8A and 8B illustrate how the loading clip may be secured to the magazine loading apparatus 100. FIGS. 9-11 illustrate various aspects and uses of the loading clip 150. Generally, the loading clip includes a handle 151 and a track 153 having a channel 1110 forming a C-shaped cross-section which allows a plurality of rounds of ammunition 1120 to slide into the channel and be retained at the end of the casing by the rim and extractor groove. As shown in FIGS. 8A and 8B, one end 152 of the loading clip 150 may be inserted in a notch 156 in the back wall 114 of the magazine loading apparatus while a second end 154 of the loading clip 150 may be fitted with a magnet 155*a* allowing the clip to secure to a reciprocal magnet 155*b* in wall 114. (Alternatively, where the apparatus is formed of metal, a reciprocal magnet may not be needed.)

To remove the clip 150, as shown in FIG. 8A, one lifts end 152 away from wall 114 and removes end 154 from slot 156. Conversely, to store clip 150, one inserts end 154 into slot 156 and attaches end 152 magnetically to the housing 114.

As illustrated in FIG. 9, the loading clip 150 can slidably attach a plurality of ammunition rounds 1120 which may be arranged in a case, box or other container. This allows a user to collect a selected number of rounds 1120 and deposit the rounds into the ammunition holding ramp 110 of the magazine loading apparatus 100. Slot 1110 is open at end 152 and closed at end 154.

Figure 12:
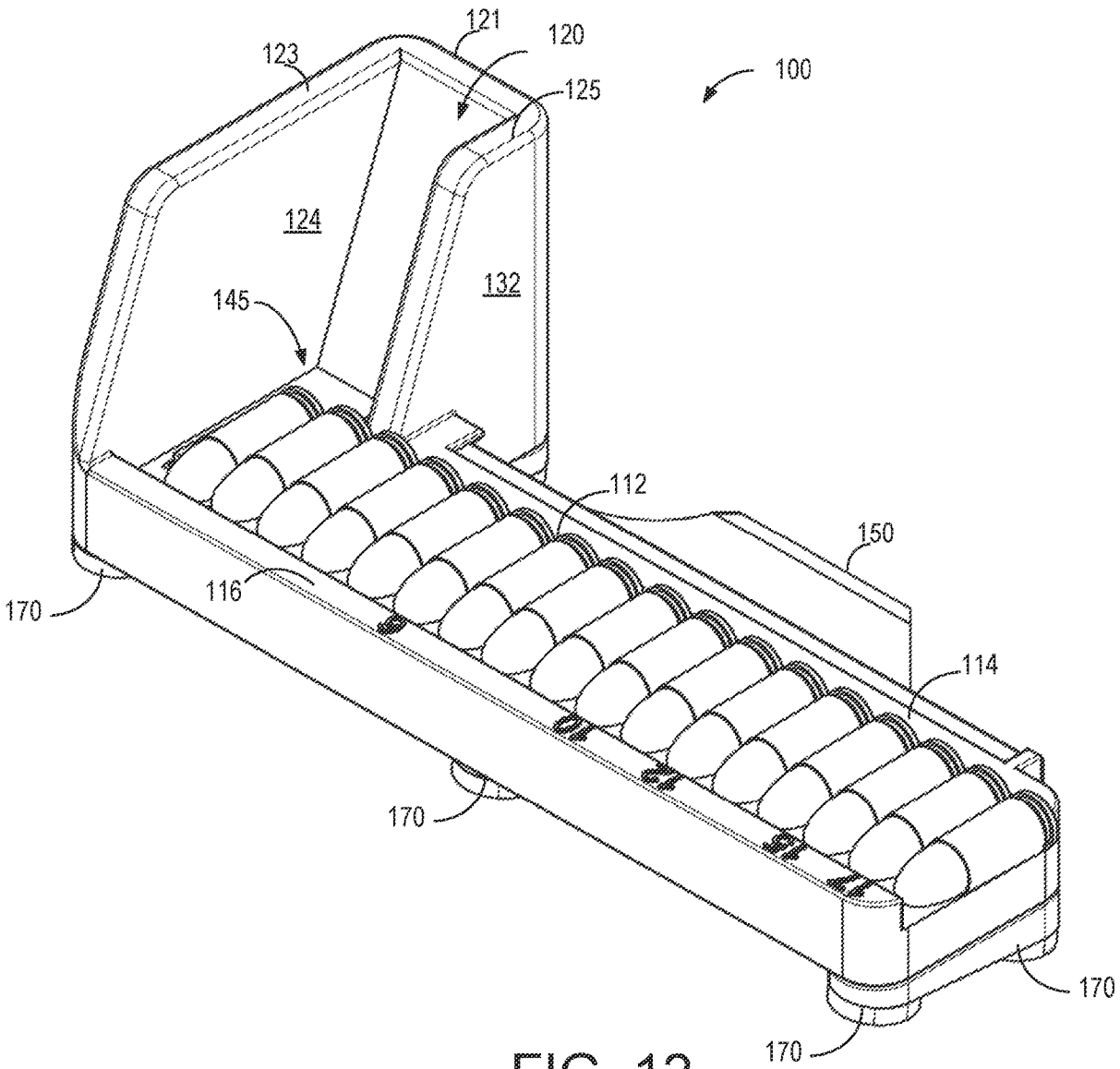
FIG. 12 is a perspective view of the plurality of rounds of ammunition loading into the magazine loading device of FIG. 1.

FIG. 12 illustrates the plurality of rounds 1120 loaded into the ammunition holding ramp 110, with one round positioned in the depression 160. As rounds are removed from the slot, the circular cross-section of the rounds and the higher feet 170*a* angling the ammunition holding ramp 110 towards the depression 160 will cause the rounds to rotate and move toward the slot, thereby depositing a next round into the slot for loading into a magazine.

Figure 13:
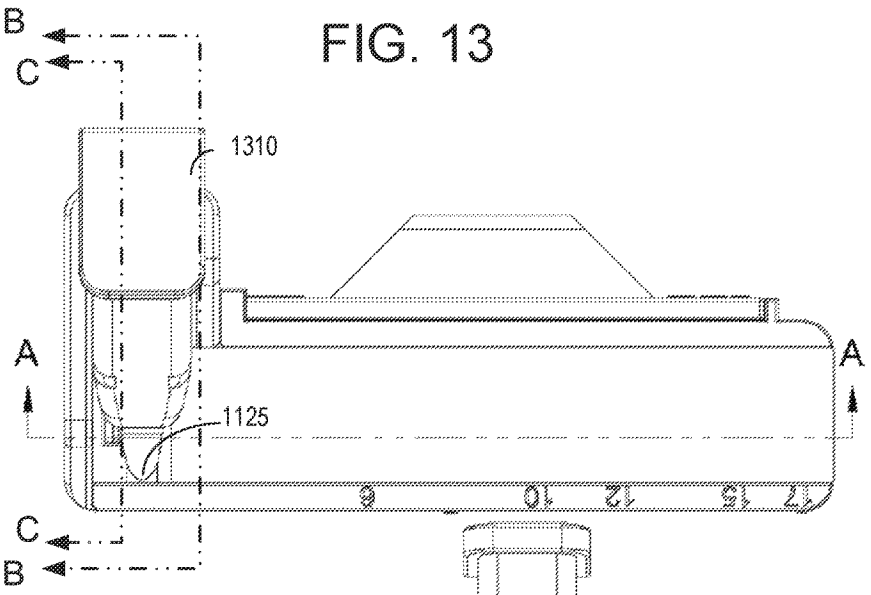
FIG. 13 is a top view illustrating the magazine loading device of FIG. 1 having a magazine loaded therein.
Figure 14B:
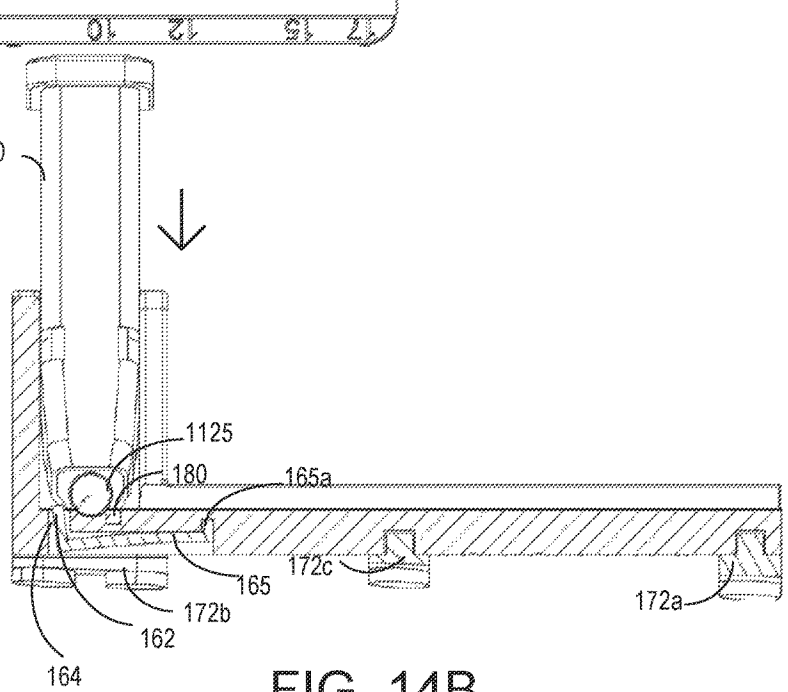
FIGS. 14A and 14B are cutaway views along line A-A in FIG. 13 illustrating how a magazine is received into the magazine loading devices disclosed herein to receive a round of ammunition.
Figure 14A:
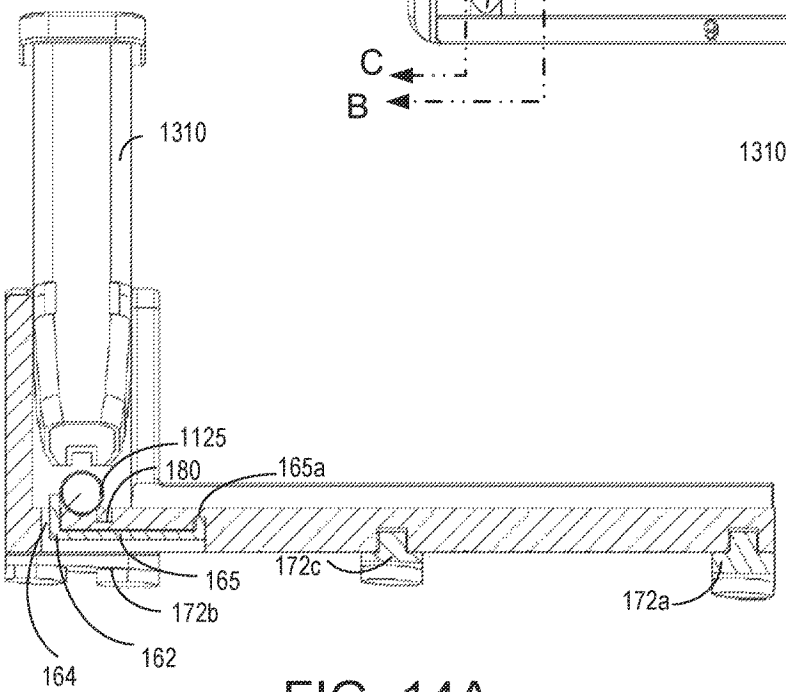

FIGS. 13-15 illustrate a magazine loading operation. FIG. 13 is a top view of the magazine loading apparatus 100 showing a magazine 1310 and one round 1125 viewable in the depression 160 at the base of the magazine. FIGS. 14A and 14*b* are views along line A-A in FIG. 13. FIGS. 15A-15F are views along line B-B in FIG. 13.

FIG. 14A also illustrate further details on construction of the leaf spring 165 and spring wall 162.

As illustrated in FIGS. 13 and 14 *a* and B, a magazine 1310 is received into the magazine holding channel 120 and is positioned therein by the inner surfaces 122, 124 and 126. However, magazine 1310 is free to slide forward and away from surface 122 as illustrated in FIGS. 15A through 15F.

In FIG. 14A, a magazine 1310 shown as positioned just above a round 1125 is in the depression 160. In operation, the magazine rests on the back surface 122 and is slid into the magazine holding channel 120 between inner side surfaces 124, 126. As shown therein, the spring wall 162 abuts one side of the round 1125 when the spring wall 162 is extended through opening 164, which is the resting position of spring wall 162. The spring wall 162 is biased against downward movement and toward returning to the resting position by a leaf-spring structure including base leaf spring 165 attached at one end 165*a* to the bottom of and extending below the ammunition holding ramp 110. In the resting position, the spring wall 162 extends through the opening 164.

As illustrated in FIG. 14B, when the magazine 1310 is forced downward through pressure by, for example, an operator, the spring wall 162 yields to allow the base of the magazine 1310 to rest upon the base surface 140 (and thereby allow sliding of the magazine forward (away from back surface 122) to insert a round therein).

FIGS. 15A through 15F illustrate a loading sequence from the perspective along line B-B in FIG. 13. In FIG. 15A, the magazine 1310 is positioned above the magazine holding channel 120 and between inner side surfaces 124 and 126. In FIG. 15*b*, (and as also illustrated in FIGS. 14A and 14*b*), the magazine 1310 may be slid into the magazine holding channel 120 in the direction towards the round 1125 resting in the depression 160. At FIG. 15C, the magazine 1310 has reached the base of the magazine holding channel 120 and engages base surface 140 and is then slid forward (toward wall 116) so that the round is inserted into the magazine 1310. At FIG. 15D, the magazine 1310 is lifted in the magazine holding channel 120 to a heigh sufficient to allow the next round in the plurality of rounds 1120 in the ammunition holding ramp 110 to rotate into depression 160 as shown in FIG. 15E. (It should be understood that the magazine 1310 may be lifted entirely out of the magazine holding channel 120, but for maximum efficiency and loading speed, the magazine need be lifted just above a height sufficient to allow the next round to roll into the depression 160.) The magazine 1310 is also pulled backward towards back surface 122 (with the order of upward and backward movements being in any order or simultaneous), and once against back surface 122, magazine 1310 is pushed downward again, forcing the next round into the magazine, and pushing any rounds in the magazine upward against the internal spring of the magazine. At this point, the magazine 1310 is once again in the position illustrated in FIG. 15C as the initial round 1125 is now within the magazine 1310. This process is repeated until each of the plurality of rounds is loaded into the magazine 1310 or until the magazine is full.

Figure 15I:
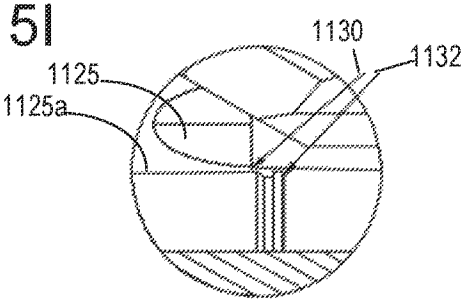
FIG. 15I is a detail of section D in FIG. 15H.
Figure 15H:
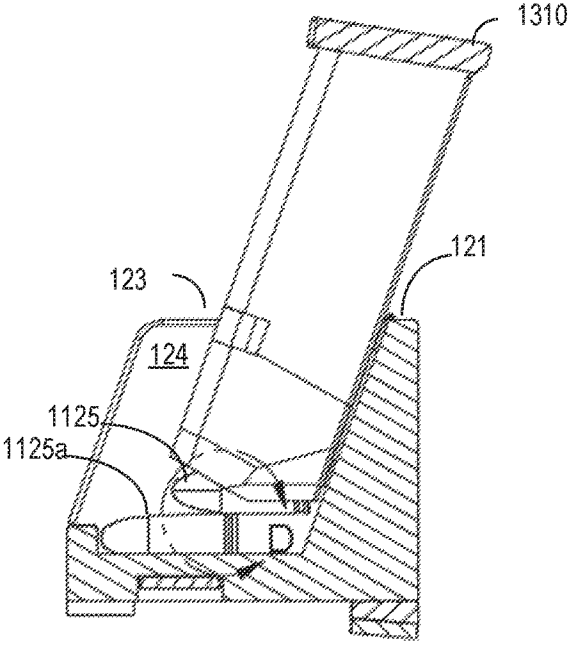
FIGS. 15G-15H are views along line C-C in FIG. 13 and illustrate the spring wall configuration and the depression and back wall spacing.
Figure 15G:
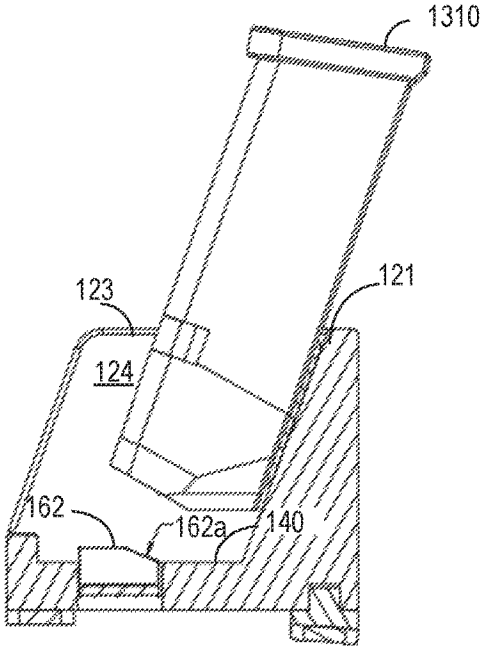

FIGS. 15G-15H are views along line C-C in FIG. 13 and illustrate the spring wall configuration and the depression and back wall spacing. As illustrated in FIG. 15G, a top surface portion 162*a* of the spring wall 162 closest to back surface 122 is angled so that when fully extended in the magazine loading region 145, the end of the top surface portion of spring wall 162 closest to back surface 122 is level with base surface 140, and is angled to extend above surface 140 as the surface approaches wall 116. This allows the magazine to force the spring wall 162 downward as it is slid forward.

FIGS. 15H and 15I illustrates the effect of the back surface 122 spacing depth "d" relative to a round positioned in the depression 160. FIG. 15I is a detail of section D in FIG. 15H. As illustrated therein, back surface 122 is angled relative to base surface 140. The angle and the position of the back surface 122 (or, as discussed below, a back-side spacer), is to ensure that when the magazine 1310 is pressed firmly against the back surface 122, the magazine is urged forward, thus moving the front edge 1130 of round 1025 forward of the back edge 1132 of the next round 1125*a*.

In the embodiment of FIGS. 1-7, the magazine loading apparatus 100 described above has a magazine holding channel 120 which is designed to be sized according to the type of magazine being loaded. In other words, the width of the magazine between inner side surfaces 124 and 126 be sized to fit either a single stack magazine, a stack-and-a-half magazine, or a double-stack magazine.

Figure 16E:
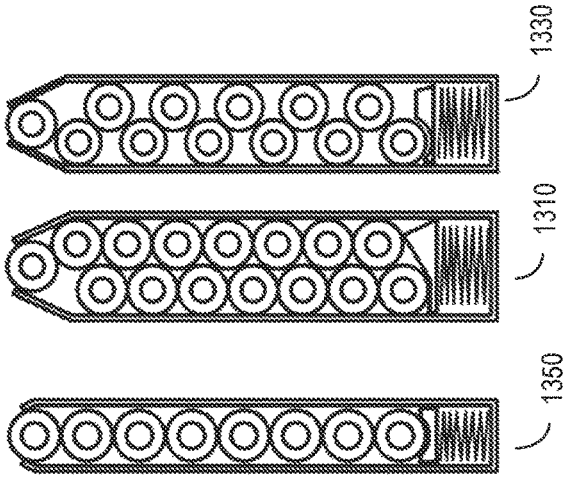
FIG. 16E illustrates different sizes of weapon magazines.
Figure 16A:
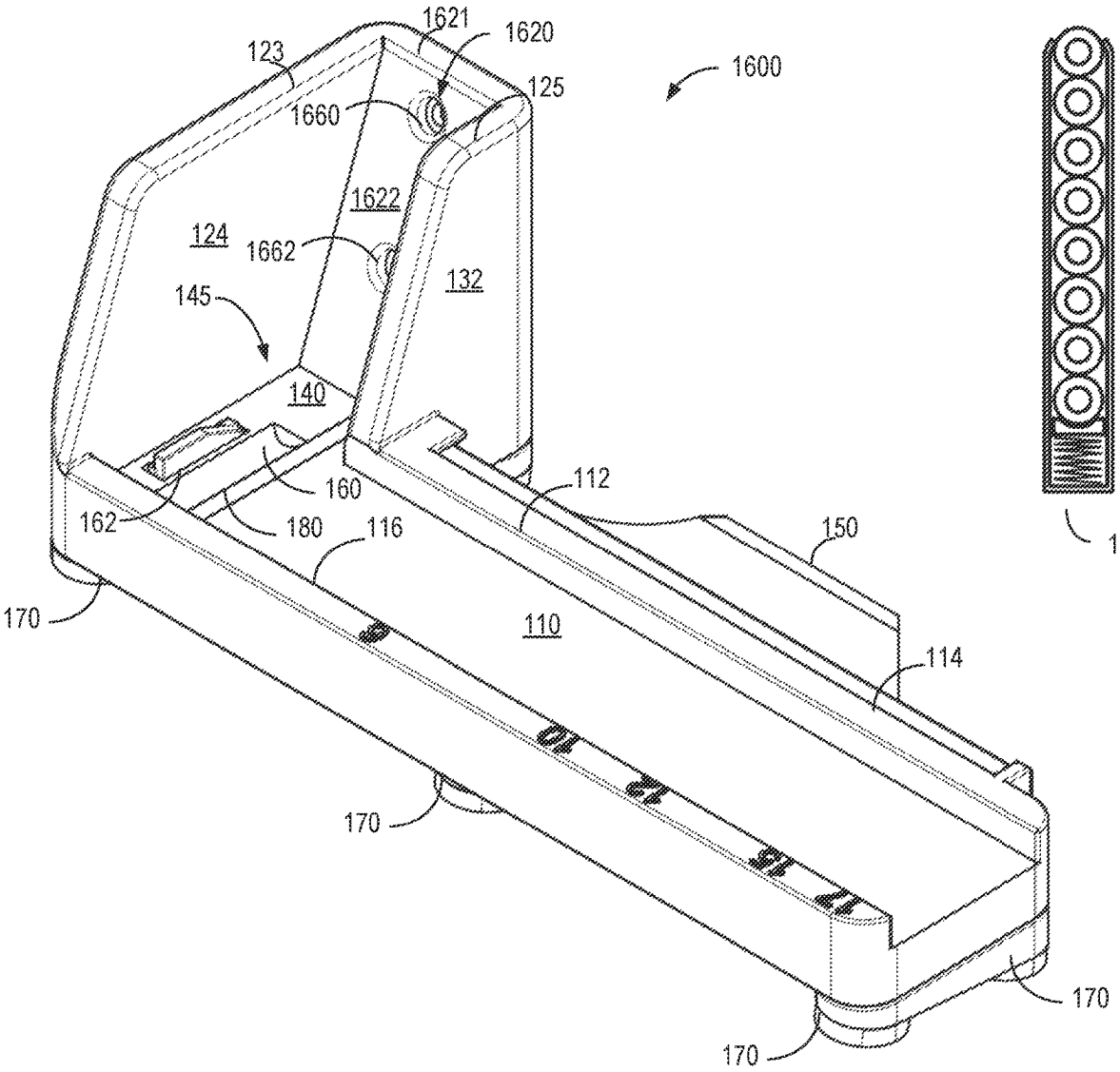
FIG. 16A is a perspective view of a second embodiment of a magazine loading device in accordance with the technology including a first spacer element.

FIGS. 16A-16D illustrate another embodiment of the magazine loading apparatus which allows different sizes of ammunition to be used in the apparatus. FIG. 16E illustrates various sizes of magazines.

Magazines may have different sizes relative to the length of a round of ammunition requiring the depth "d" of the mounting region to change. In addition, as illustrated in FIG. 16E, weapon magazines may come in various capacities. As illustrated in FIG. 16E, magazines may comprise a single stack magazine 1350, a stack-and-a-half (e.g. a 1.5 magazine) magazine 1330 and a double-stack magazine 1310. Each caliber of ammunition may also have a different length and hence the magazines may have different (front to rear) lengths.

As illustrated in FIGS. 16A-16D, the magazine loading apparatus 1600 differs from the magazine loading apparatus 100 in that one or more adjustment structures are used to change the depth "d" of the magazine loading channel. In additional embodiments, discussed below, adjustment structures may also be used to alter the width of the magazine loading channel.

In the embodiment of FIG. 16A-16D, spacer mounting structures are provided in the surfaces of the magazine loading channel 1620. In the FIGs., similar reference characters denote similar elements throughout the several views. For example, magazine loading apparatus 1600 includes a magazine loading channel 1620 with a back-wall surface 1622 which includes two spacer mounting structures 1660, 1662. Surface 1622 is equivalent to surface 122 above but includes the spacer mounting structures. Magazine loading channel 1620 is equivalent to channel 120. Spacer mounting structures 1660 and 1662 are provided on back surface 1622 of magazine loading channel 1620 of magazine loading apparatus 1600. Each mounting structure may comprise any suitable structure or mechanism which can secure a spacer (illustrated in FIGS. 16C and 16D) on the surface 1622. In one embodiment, the mounting structure is a hole having a magnet having polarity opposing magnets positioned at corresponding locations on the spacer. In another embodiment, each mounting structure is a hole in the surface having 1611 a decreasing cross-section which allows a spacer having corresponding molded posts to be provided therein.

Figures 16B, 16C:
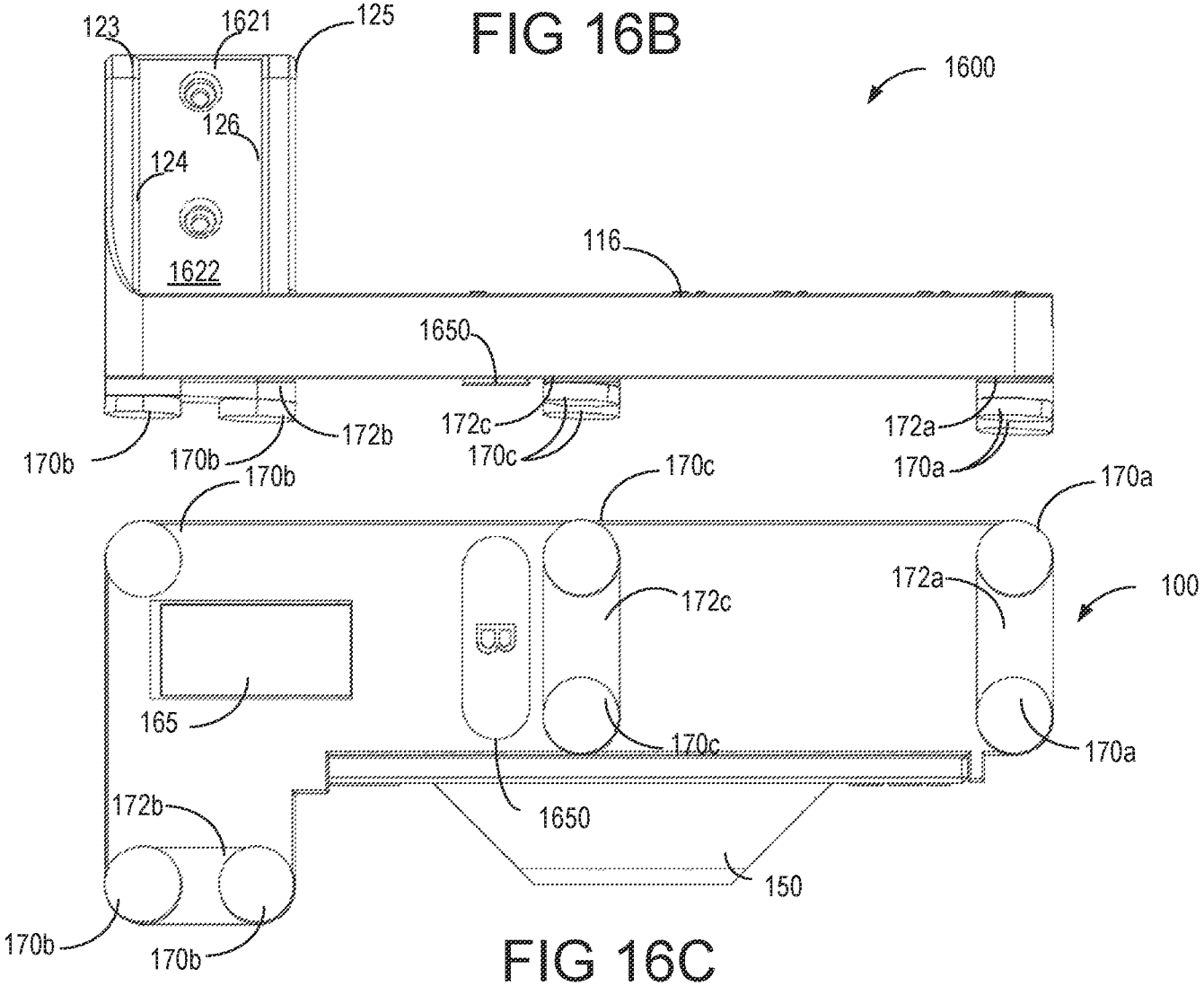
FIG. 16B is a front view and FIG. 16C a bottom view of the magazine loading device illustrated in FIG. 16A.

As illustrated in FIG. 16C, various different types of spacers may be included with the magazine loading apparatus 1600 and, in the embodiment shown in FIGS. 16B and 16C, may be secured to the bottom surface of the magazine loading apparatus 1600. In FIG. 16C, five spacers are shown. A back-wall spacer, 1650, labeled "B" is designed to be mounted to surface 1622 to ensure that, as illustrated in FIG. 15I, the edges of respective rounds to not catch each other when loading. In another embodiment, discussed below, side wall spacers are also provided. FIG. 16C illustrates four side-wall spacers, 1652 and 1654.

Figure 16D:
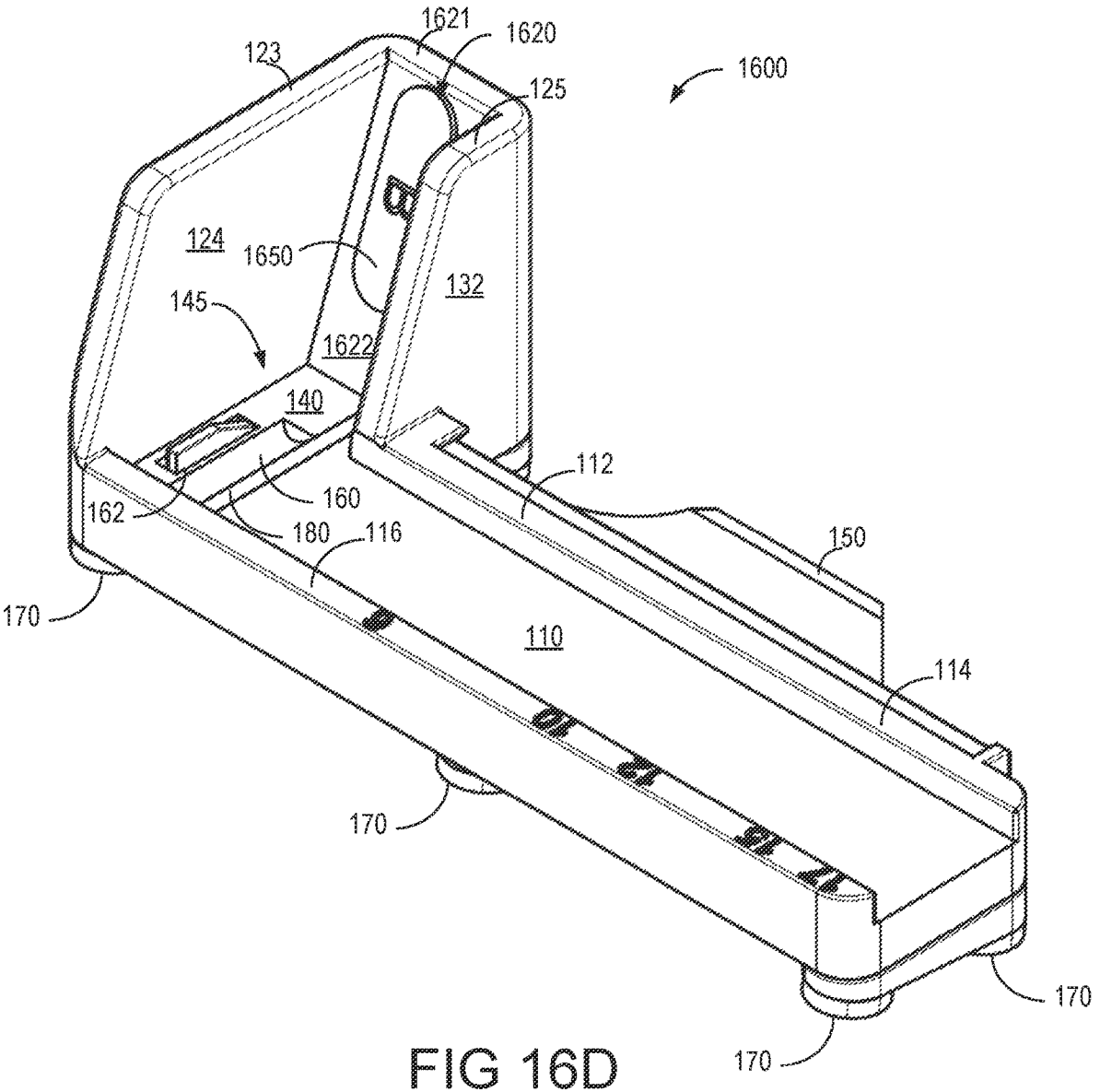
FIG. 16D is a perspective view of the embodiment of the magazine loading device illustrated in FIG. 16A including an installed spacer.

FIG. 16D illustrates the back-wall spacer 1650 mounted to back surface 1622. While FIGS. 16A-D illustrate mounting structures for only a back spacer (on surface 1622), side spacers may also be provided.

It should be understood that various alternative types of adjustment structures may be provided, and the spacer shape illustrated in the FIGs. may take alternative forms. For example, inverted u-shaped spacers may be hung over walls 121, 123, and/or 125, each of which has an inner surface sized to adjust the width "w" and/or depth "d" as needed to accommodate a differently sized magazine. In another alternative, a spacer such as spacers 1650, 1752, 1754 may be attached to screws passing through each of walls 121, 123, 125, which move the spacer forward and backward relative to the wall by turning the screw.

Figure 17A:
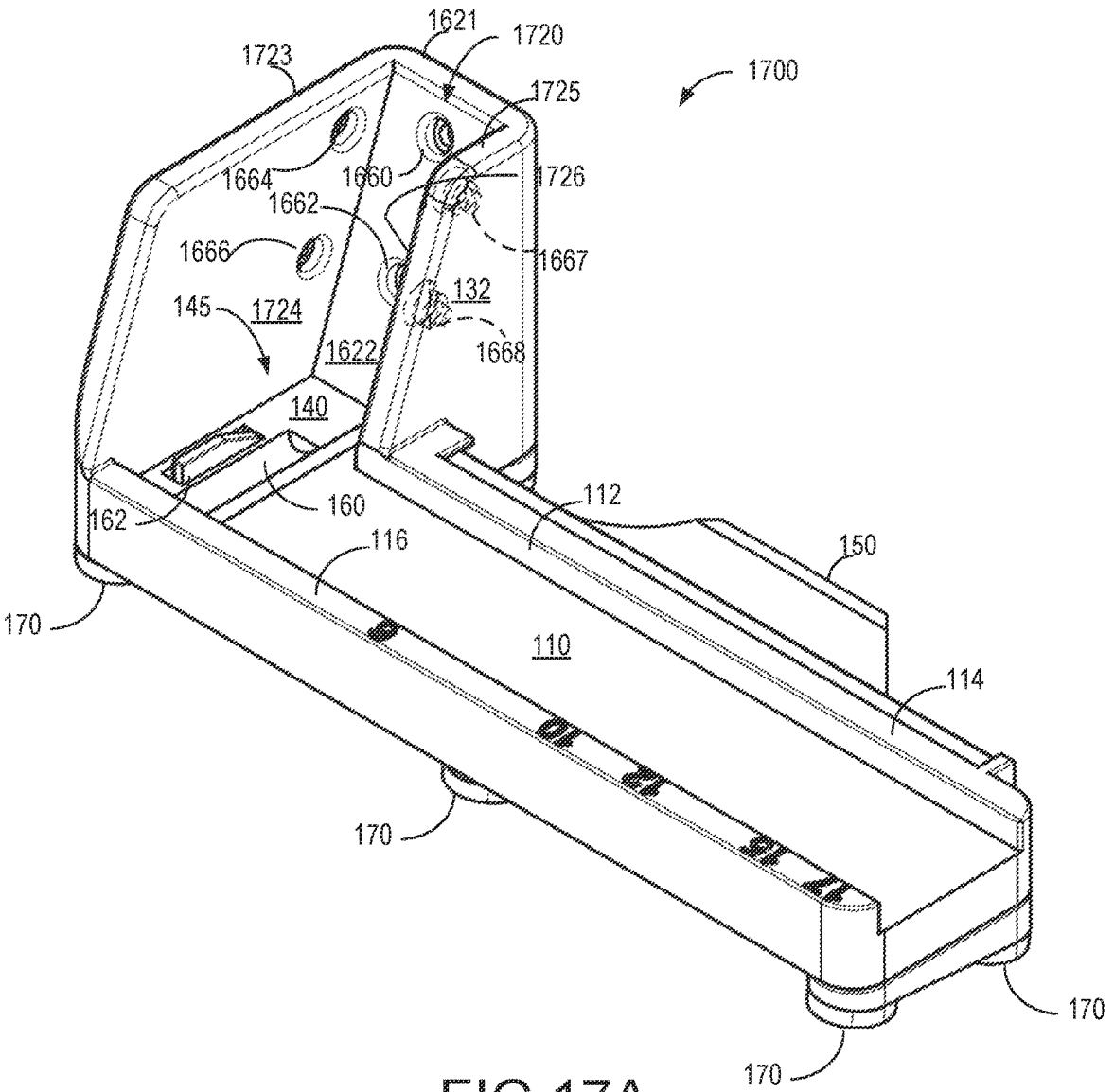
FIG. 17A—17C is a perspective, front and bottom view, respectively, of another embodiment of a magazine loading device having mounts for both back and side spacers to be used in the magazine holding channel.
Figures 17B, 17C:
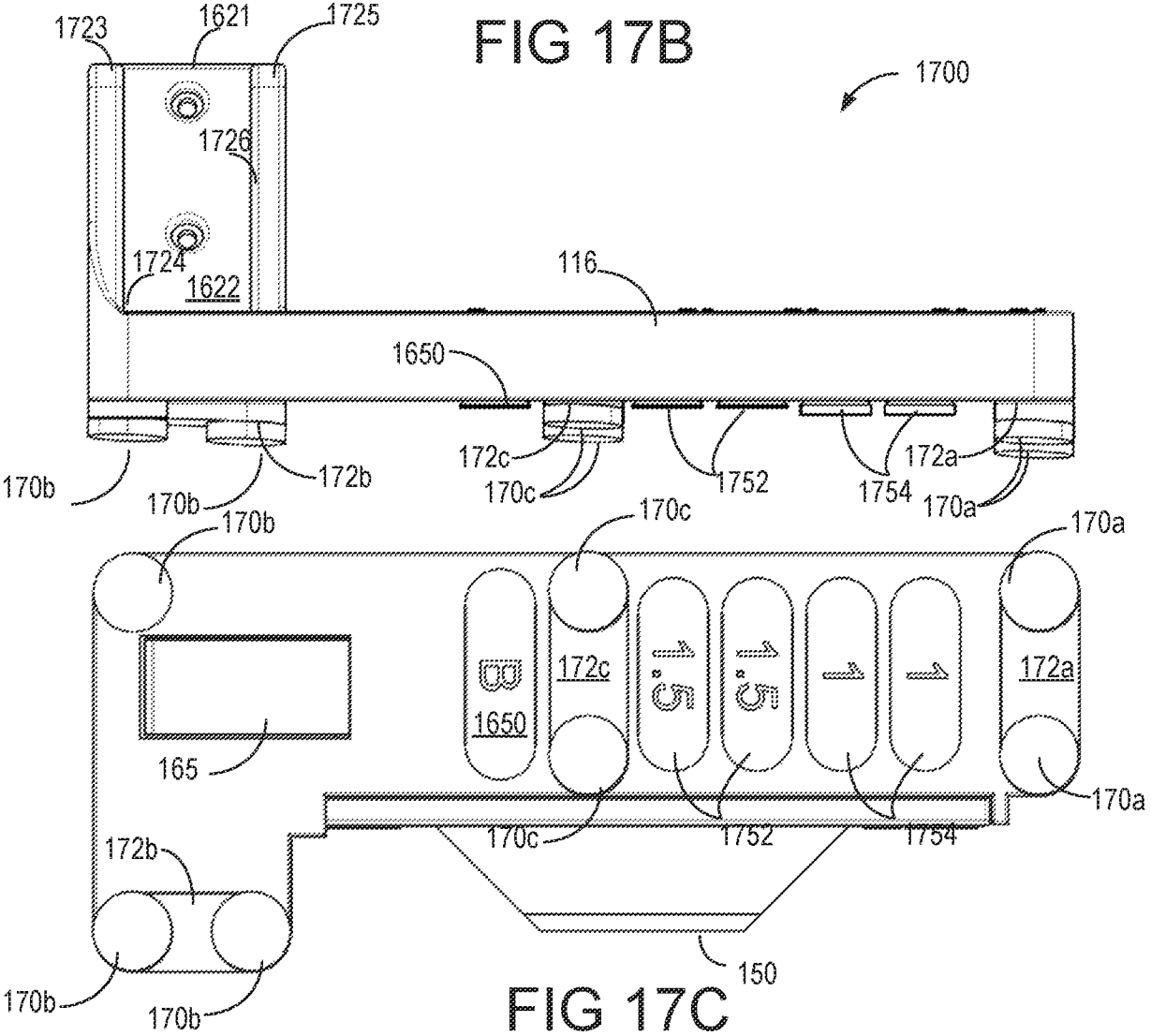

FIGS. 17A-17C illustrates another embodiment of the magazine loading apparatus which allows multiple different sizes of magazine to be used in the apparatus. In apparatus 1700, both back wall spacer mounting structures 1660 and 1662, and side wall mounting structures 1664, 1666, 1667, 1668 are provided. Surfaces 1724 and 1726 on walls 1723 and 1725 are equivalent to surfaces 124 and 126 but for the addition of the side wall mounting structures. Multiple spacer elements, including back spacer 1650 and side spacers 1752 and 1754 can be secured to the bottom surface of the ammunition holding ramp 110 by magnets and mounting structures similar to structures 1664-1668. Magazine loading channel 1720 is equivalent to channel 120.

Figure 19:
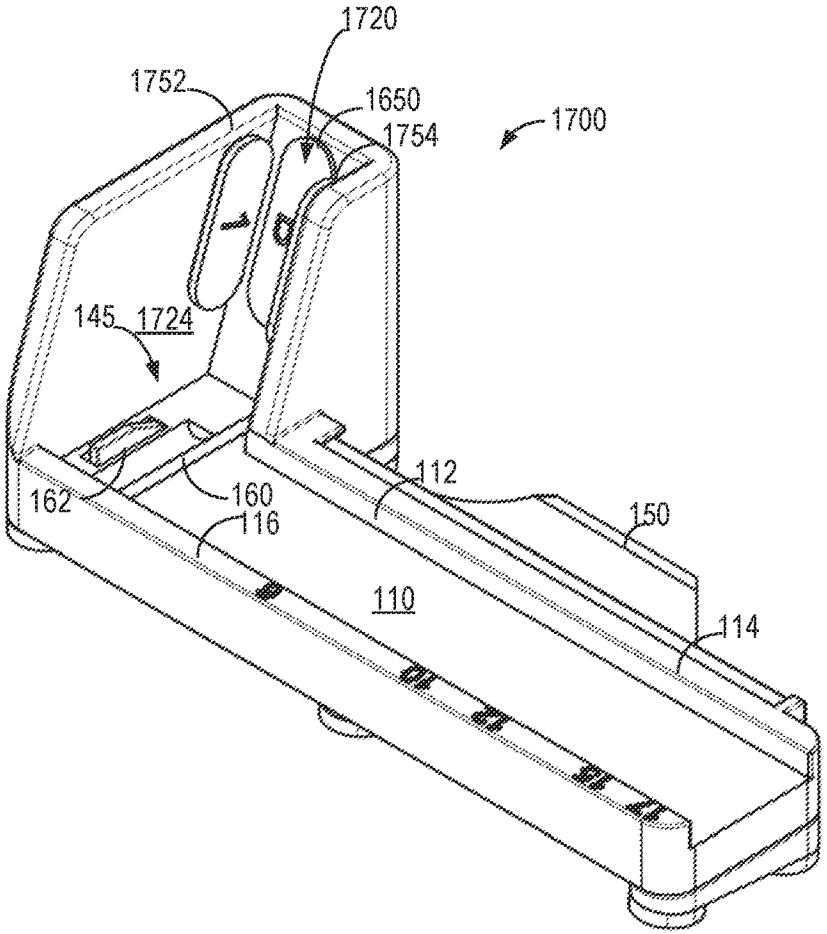
FIG. 19 is a perspective view of the magazine loading device of FIG. 17 illustrating installation of both a back spacer and the first size of side spacers.
Figure 18:
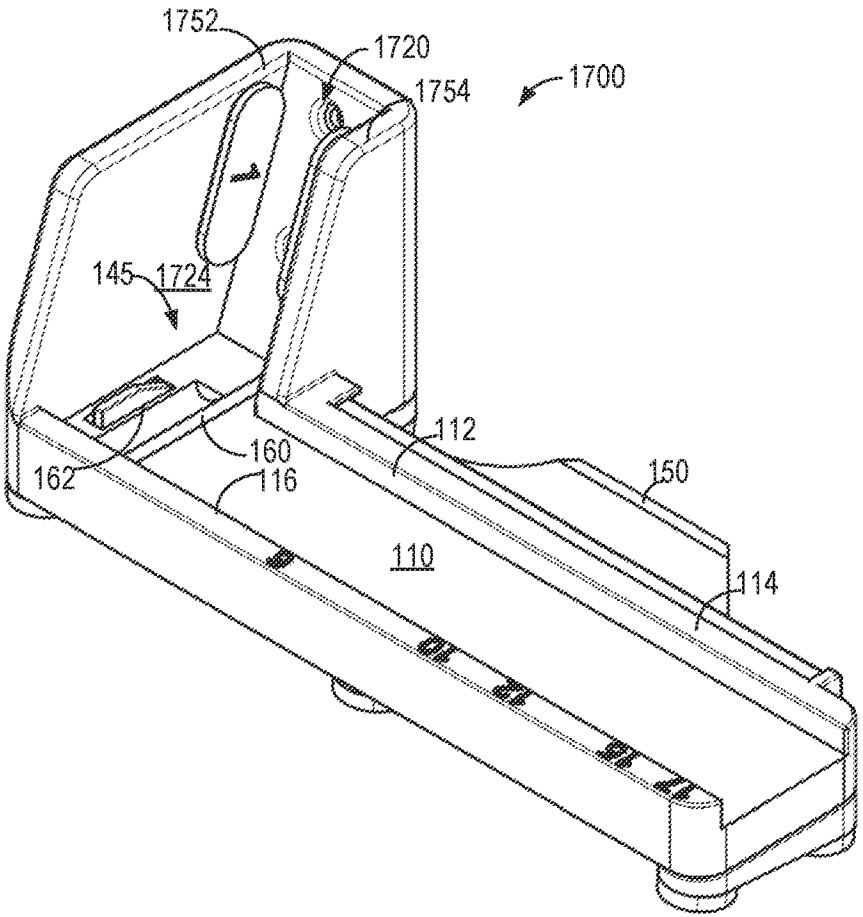
FIG. 18 is a perspective view of the magazine loading device of FIG. 17 illustrating installation of a first size of side spacers therein.
Figure 21:
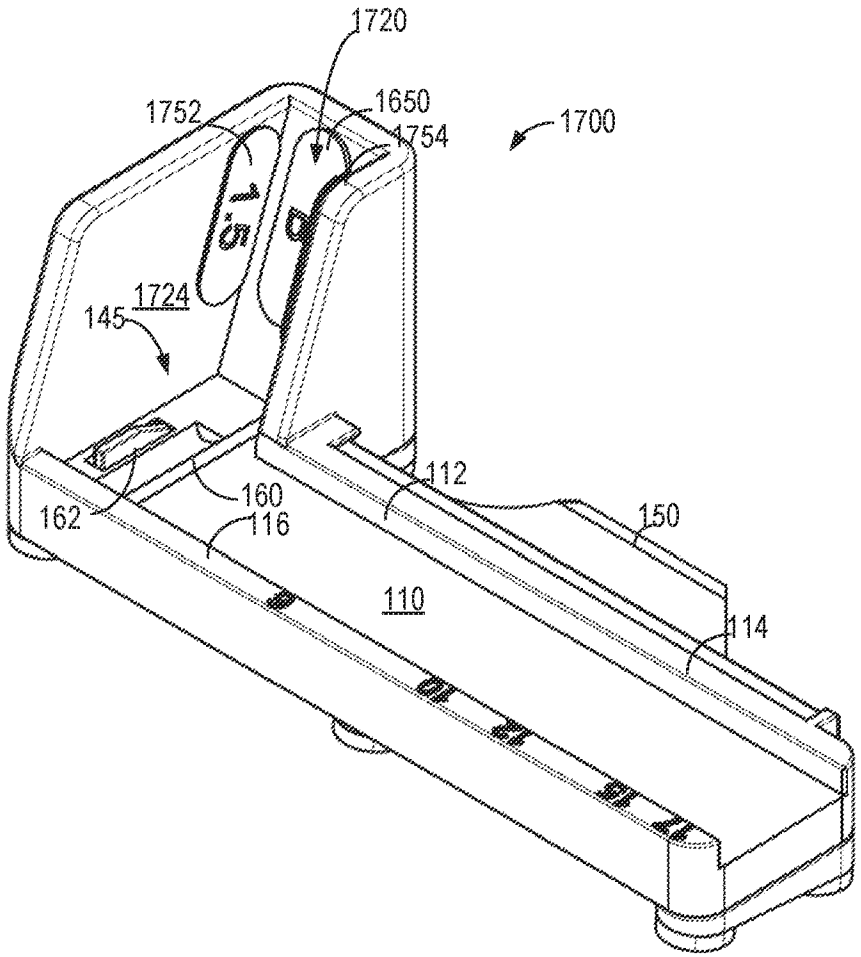
FIG. 21 is a perspective view of the magazine loading device of FIG. 17 illustrating installation of both a back spacer and the second size of side spacers.
Figure 20:
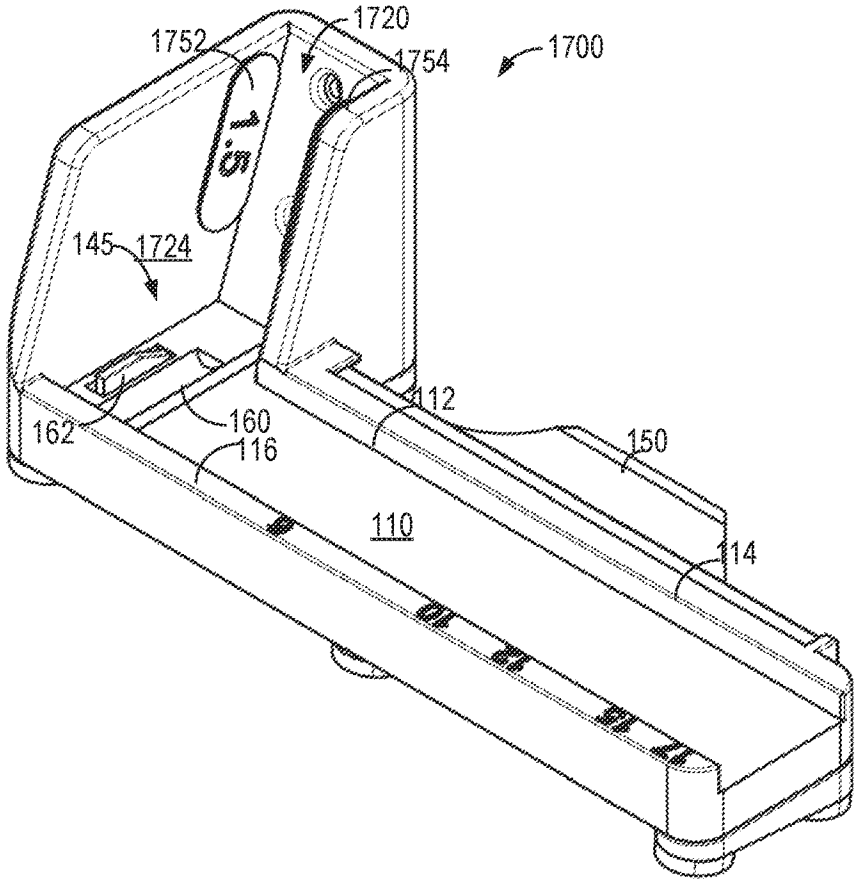
FIG. 20 is a perspective view of the magazine loading device of FIG. 17 illustrating installation of a second size of side spacers therein.

As illustrated in FIGS. 18-21, various combinations of spacers may be used. In FIG. 18, only single stack magazine sidewall spacers (designated with a "1" for easy reference by a user) are mounted in the channel 1720, and no back-wall spacer is used. While two side wall spacers, one per each inner wall, are used, in alternative embodiments, only one side wall spacer need be used. In FIG. 19, single stack magazine sidewall spacers are mounted in the channel 1720, and a back-wall spacer "B" is also used. Again, while two side wall spacers, one per each inner wall, are used, in alternative embodiments, only one side wall spacer need be used. In FIG. 20, stack-and-a-half magazine sidewall spacers (designated "1.5" for easy reference) are mounted in the channel 1720, and no back-wall spacer is used. In FIG. 21, stack-and-a-half magazine sidewall spacers are mounted in the channel 1720, and a back-wall spacer is used.

Figure 22:
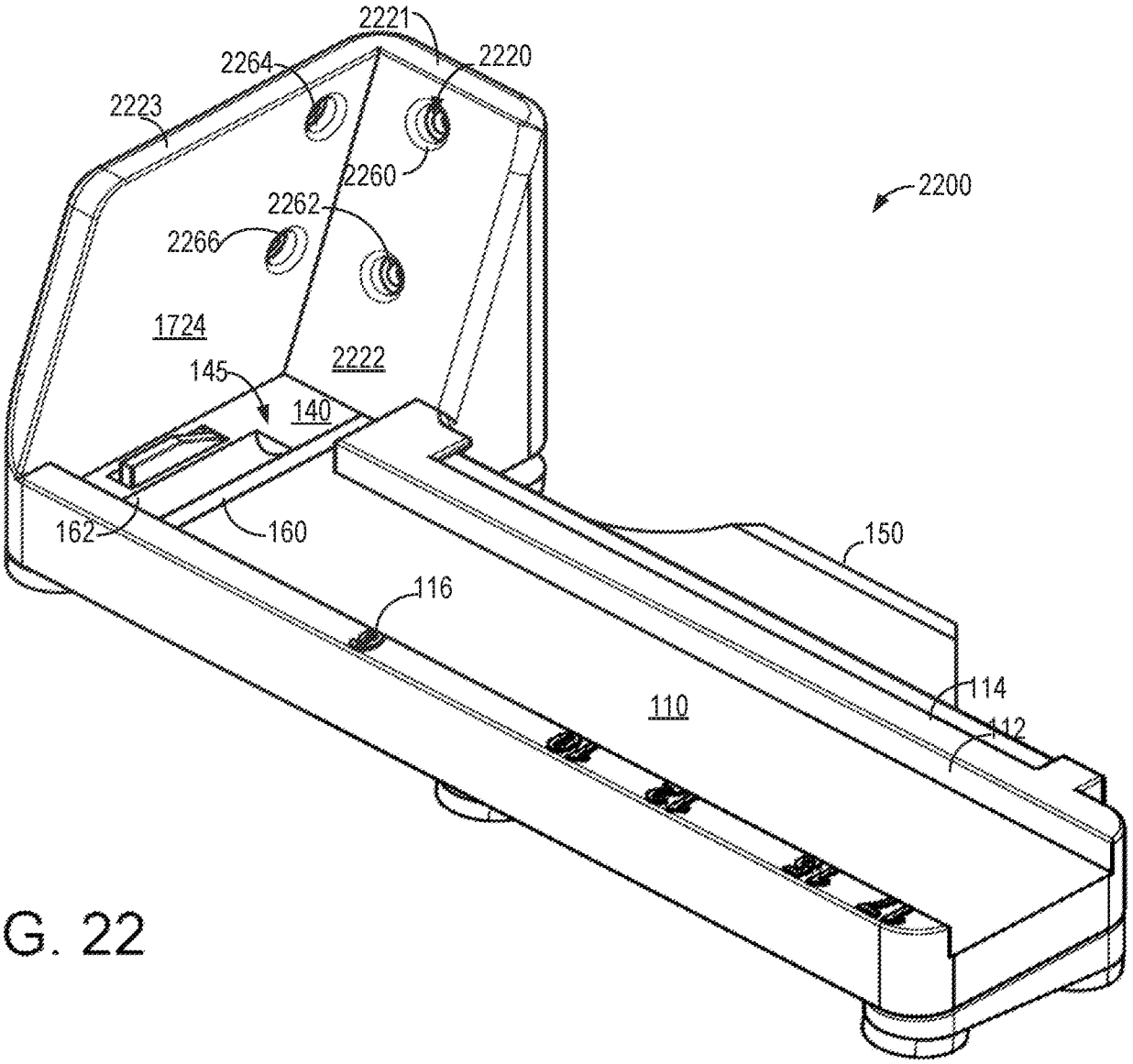
FIGS. 22 and 23 are perspective views of another embodiment of a magazine loading device illustrating a loading region having only one side wall and using either or both of a back spacer and a side spacer.
Figure 23:
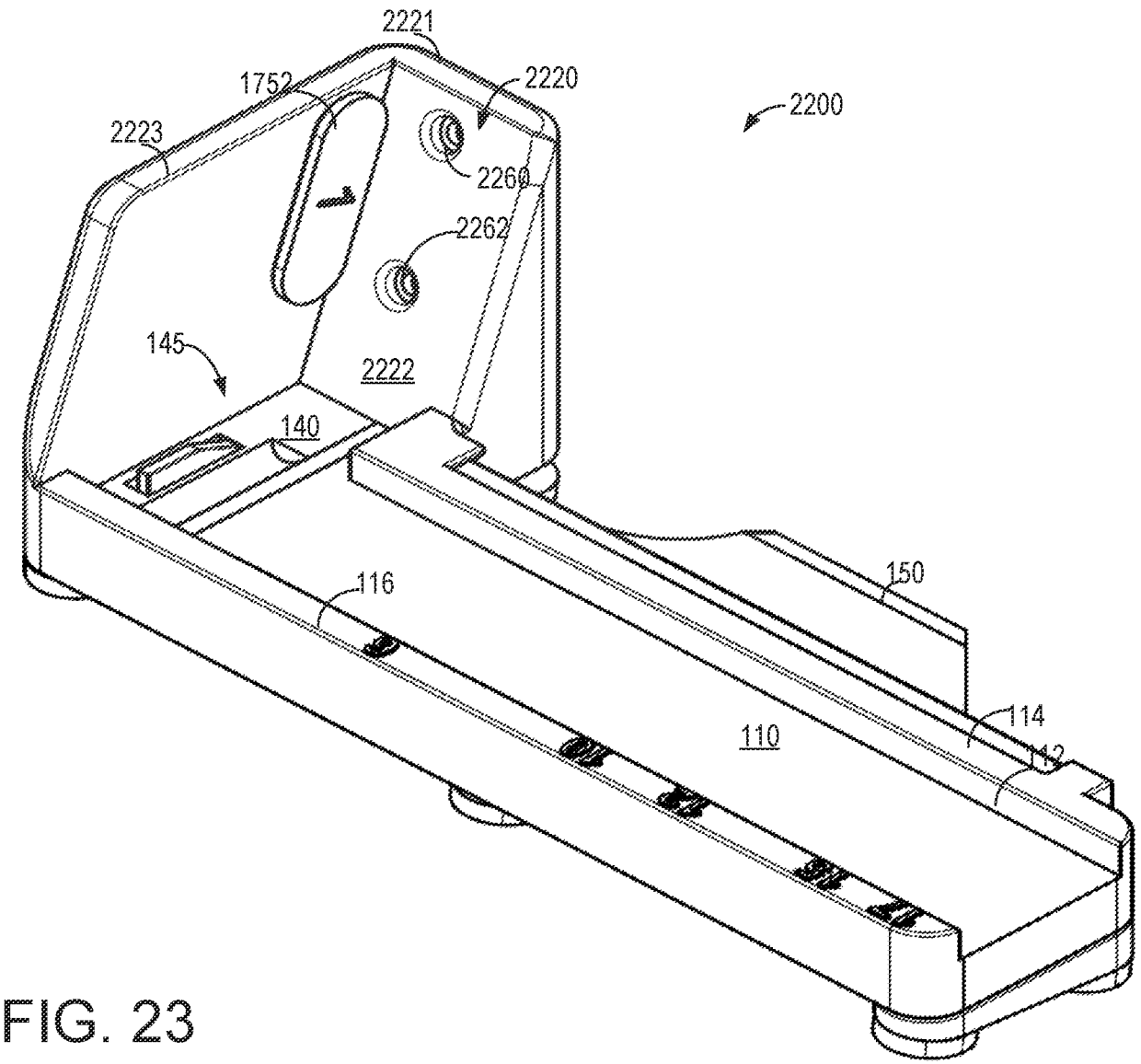

FIGS. 22 and 23 are perspective views of the another embodiment of a magazine loading device illustrating a loading region having only one side wall and using either or both of a back spacer and a side spacer. Again, similar reference characters denote similar elements throughout the several views. In this embodiment, one side wall (for example wall 1725 in FIGS. 18-21) is eliminated and one or both of a side and back spacer (or no spacers) can be utilized in this embodiment. The loading region 2200 is defined by walls 2221 and 2223, each having spacer mounting structures, 2260, 2262, 2264, 2266, which can be used to mount spacers as described above. FIG. 23 shows only one spacer in place, but as should be understood, both a side and back spacer, one spacer or no spacers may be used based on the size of the magazine.

The apparatus disclosed herein allows for the rapid loading of weapon magazines while additionally providing users with limited dexterity and strength with an easier means of loading various types of magazines. The apparatus is adjustable by the user through the use of adjustment mechanisms (such as spacers) to allow for different sizes of ammunition and different capacities of magazines. This allows a user to load various sizes and quantities of ammunition rounds using a single, adjustable apparatus. The apparatus may be advantageously used on any planar surface, such as a table or desk, where it is convenient for the user.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A weapon magazine loading apparatus, comprising:

a magazine guide channel having a back surface, a first side surface and a second side surface;

a magazine loading region at a base of the magazine guide channel, the magazine loading region including a base surface, an ammunition round holding depression formed in the base surface, and a spring-loaded retaining wall positioned adjacent to the round holding depression, the retaining wall movable between a first position extending into the loading region above the base surface and a second position even with the base surface; and an ammunition holding ramp positioned adjacent to the magazine loading region, the ramp adapted to hold a plurality of rounds of ammunition, the ramp being positioned at an angle such that a round of ammunition in the ammunition holding ramp will move toward the magazine loading region.

2. The apparatus of claim 1 wherein the retaining wall is attached to a leaf spring positioned below the loading region.

3. The apparatus of claim 1 wherein the magazine guide channel has a width between the first side surface and the second side surface which allows a weapon magazine to pass therethrough will minimal resistance.

4. The apparatus of claim 1 wherein the guide channel has a width between the first side surface and the second side surface, and wherein the magazine guide channel is adapted to include a width adjustment structure.

5. The apparatus of claim 4 wherein the width adjustment structure includes at least one spacer mounting structure and at least one spacer.

6. The apparatus of claim 4 wherein the width adjustment structure includes at least one spacer mounting structure on each of the first side surface and the second side surface, and at least one spacer for each mounting structure.

7. The apparatus of claim 4 wherein the width of the guide channel is sufficient to allow a double-stack magazine therein, and wherein a first adjustment structure reduces the width such that the guide channel is adapted to receive a stack-and-a-half magazine.

8. The apparatus of claim 4 wherein the width of the guide channel is sufficient to allow a double-stack magazine therein, and wherein a first adjustment structure reduces the width such that the guide channel is adapted to receive a single stack magazine.

9. The apparatus of claim 4 wherein the width of the guide channel is sufficient to allow a double-stack magazine therein, and wherein a first adjustment structure reduces the width such that the guide channel is adapted to receive a stack-and-a-half magazine; and a second adjustment structure reduces the width such that the guide channel is adapted to receive a single stack magazine.

10. The apparatus of claim 1 further including a loading clip adapted to secure a plurality of ammunition rounds in a row, the loading clip removably secured to a wall adjacent to the holding ramp.

11. An apparatus, comprising:

an adjustable guide channel having a base surface, a back surface, a first side surface and a second side surface;

a loading region adjacent to the base surface of the guide channel, the loading region including an ammunition holding depression formed in the base surface, and a movable retaining element positioned adjacent to the holding depression, the retaining element movable between a first position extending into the loading region above the base surface and a second position even with the base surface; and an ammunition holding ramp positioned adjacent to the loading region, the ramp being positioned at an angle such that a round of ammunition in the ammunition holding ramp will move toward the magazine loading region.

12. The apparatus of claim 11 wherein the retaining element is attached to a leaf spring positioned below the loading region.

13. The apparatus of claim 11 wherein the guide channel has a width between the first side surface and the second side surface, and wherein the magazine guide channel is adapted to include a width adjustment structure.

14. The apparatus of claim 13 wherein the width adjustment structure includes at least one spacer mounting structure and at least one spacer.

15. The apparatus of claim 14 wherein the width adjustment structure includes at least one spacer mounting structure on each of the first side surface and the second side surface, and at least one spacer for each mounting structure.

16. The apparatus of claim 15 wherein apparatus further includes a back spacer mounting structure positioned on the back surface.

17. The apparatus of claim 16 wherein the ramp includes a top surface adapted to hold ammunition and a bottom surface, and the bottom surface includes at least one spacer mounting structure adapted to secure each said spacer to the bottom surface.

18. The apparatus of claim 17 further including a loading clip adapted to secure a plurality of ammunition rounds in a row, the loading clip removably secured to a wall adjacent to the holding ramp.

19. A method of loading an ammunition magazine, comprising:

loading a plurality of rounds of ammunition into an ammunition holding ramp which feeds a magazine loading region, the ramp being positioned at an angle such that a round of ammunition in the ammunition holding ramp will move toward the magazine loading region;

adjusting a size of a magazine guide channel positioned above the magazine loading region, the magazine guide channel having a back surface, a first side surface and a second side surface, by securing one or more spacers to at least one of the surfaces;

inserting a magazine into the magazine loading channel and engaging an ammunition round secured in a holding depression formed in the base surface;

depressing the magazine against a spring-loaded retaining element positioned adjacent to the round holding depression to insert the round into the magazine;

lifting the magazine in the channel to allow another of the plurality of rounds to roll on the ramp into the holding depression; and repeating the depressing and lifting so that all of the plurality of rounds are inserted into the magazine.

* * * * *